US010376775B2

(12) United States Patent
French

(10) Patent No.: US 10,376,775 B2
(45) **Date of Patent: *Aug. 13, 2019**

(54) READ AND WRITE PLAYING CARD SYSTEM AND METHOD

(71) Applicant: John B. French, Reno, NV (US)

(72) Inventor: John B. French, Reno, NV (US)

(73) Assignee: Milestone Technologies, Eagle, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/713,964

(22) Filed: May 15, 2015

(65) Prior Publication Data

US 2015/0335989 A1 Nov. 26, 2015

Related U.S. Application Data

(63) Continuation of application No. 13/963,945, filed on Aug. 9, 2013, now Pat. No. 9,061,197, which is a (Continued)

(51) Int. Cl.
*A63F 9/24* (2006.01)
*A63F 1/02* (2006.01)
(Continued)

(52) U.S. Cl.
CPC ..... *A63F 1/02* (2013.01); *A63F 1/10* (2013.01); *A63F 1/18* (2013.01); *G07F 17/32* (2013.01);
(Continued)

(58) Field of Classification Search
CPC ..... G07F 17/3241; A63F 1/02; A63F 1/10; A63F 2009/2429
See application file for complete search history.

(56) References Cited

U.S. PATENT DOCUMENTS 5,779,546 A 7/1998 Meissner et al.
6,206,292 B1 3/2001 Robertz et al.
(Continued)

FOREIGN PATENT DOCUMENTS

EP 1762991 A 3/2007
GB 2428013 A 1/2007
WO 2007/067213 A 6/2007

OTHER PUBLICATIONS

IP Autralia, Examination Report No. 1 for Standard Patent Application for Application No. 2016204692; dated Jun. 30, 2017; 3 pgs.

*Primary Examiner* — Steve Rowland
(74) *Attorney, Agent, or Firm* — Kerr IP Group, LLC

(57) ABSTRACT

A read and write playing card system and method are described. The playing card includes a unique card identification that uniquely identifies the playing card from other cards in the deck of playing cards. Additionally, the read and write playing card includes at least one playing card electronic component that receives data regarding game play. Furthermore, the read and write playing card includes at least one of the playing card electronic components that stores data regarding game play. Further still, the read and write playing card includes at least one of the playing card electronic components that transmits the unique card identification data, when activated by the electronic system.

12 Claims, 21 Drawing Sheets

Related U.S. Application Data continuation of application No. 13/539,036, filed on Jun. 29, 2012, now Pat. No. 8,535,136, which is a continuation of application No. 12/271,813, filed on Nov. 14, 2008, now Pat. No. 8,221,244, which is a continuation-in-part of application No. 11/838,230, filed on Aug. 14, 2007, now Pat. No. 8,235,825.

(60) Provisional application No. 60/988,429, filed on Nov. 15, 2007.

(51) Int. Cl.

| | |
|---|---|
| ***A63F 1/10*** | (2006.01) |
| ***A63F 1/18*** | (2006.01) |
| ***G07F 17/32*** | (2006.01) |
| *A63F 1/00* | (2006.01) |

(52) U.S. Cl.

CPC ..... *G07F 17/322* (2013.01); *G07F 17/3232* (2013.01); *G07F 17/3241* (2013.01); *A63F 2001/003* (2013.01)

(56) References Cited

U.S. PATENT DOCUMENTS

| | | | | |
|---|---|---|---|---|
| 6,403,908 | B2 * | 6/2002 | Stardust | A63F 1/14 209/547 |
| 6,638,161 | B2 | 10/2003 | Soltys et al. | |
| 6,951,596 | B2 | 10/2005 | Green et al. | |
| 6,957,777 | B1 | 10/2005 | Huang | |
| 6,986,826 | B2 | 1/2006 | Dronzek | |
| 7,017,799 | B2 | 3/2006 | Schwander | |
| 7,023,347 | B2 | 4/2006 | Arneson et al. | |
| 7,055,756 | B2 | 6/2006 | Anderson et al. | |
| 7,057,562 | B2 | 6/2006 | Forster et al. | |
| 7,059,518 | B2 | 6/2006 | Forster | |
| 7,061,382 | B2 | 6/2006 | Claessens et al. | |
| 7,066,393 | B2 | 6/2006 | Stromberg et al. | |
| 7,071,826 | B2 | 7/2006 | Peterson | |
| 7,102,520 | B2 | 9/2006 | Liu et al. | |
| 7,109,867 | B2 | 9/2006 | Forster | |
| 7,117,581 | B2 | 10/2006 | Arneson et al. | |
| 7,135,979 | B2 | 11/2006 | Savagian et al. | |
| 7,137,000 | B2 | 11/2006 | Hohberger et al. | |
| 7,151,979 | B2 | 12/2006 | Andersen et al. | |
| 7,152,803 | B2 | 12/2006 | Stromberg | |
| 7,154,283 | B1 | 12/2006 | Weakley et al. | |
| 7,158,033 | B2 | 1/2007 | Forster | |
| 7,172,130 | B2 | 2/2007 | Tsunoda et al. | |
| 7,187,293 | B2 | 3/2007 | White et al. | |
| 7,199,456 | B2 | 4/2007 | Krappe et al. | |
| 7,212,127 | B2 | 5/2007 | Jacober et al. | |
| 7,223,320 | B2 | 5/2007 | Arneson et al. | |
| 7,224,280 | B2 | 5/2007 | Ferguson et al. | |
| 8,235,825 | B2 * | 8/2012 | French | G07F 17/32 463/47 |
| 2001/0000118 | A1 | 4/2001 | Sines et al. | |
| 2002/0032058 | A1 | 3/2002 | Sugimura | |
| 2002/0155869 | A1 | 10/2002 | Soltys et al. | |
| 2004/0147327 | A1 | 7/2004 | Soltys et al. | |
| 2004/0195772 | A1 | 10/2004 | Marlow | |
| 2004/0259618 | A1 | 12/2004 | Soltys et al. | |
| 2005/0121852 | A1 | 6/2005 | Soltys et al. | |
| 2005/0288083 | A1 | 12/2005 | Downs, III | |
| 2006/0027970 | A1 | 2/2006 | Kyrychenko | |
| 2006/0135238 | A1 | 6/2006 | Lancaster et al. | |
| 2007/0018389 | A1 | 1/2007 | Downs, III | |
| 2007/0052167 | A1 | 3/2007 | Galatan | |
| 2007/0060311 | A1 | 3/2007 | Rowe et al. | |
| 2008/0070658 | A1 | 3/2008 | Labgold et al. | |
| 2008/0076500 | A1 | 3/2008 | Lancaster et al. | |
| 2008/0076505 | A1 | 3/2008 | Nguyen et al. | |
| 2009/0124313 | A1 | 3/2009 | Nicely | |
| 2009/0098921 | A1 | 4/2009 | Manning et al. | |
| 2009/0191933 | A1 | 7/2009 | French | |
| 2010/0004051 | A1 | 1/2010 | Walker et al. | |
| 2010/0013118 | A1 | 1/2010 | Shigeta | |
| 2010/0093428 | A1 | 4/2010 | Mattice et al. | |
| 2010/0093429 | A1 | 4/2010 | Mattice et al. | |
| 2011/0130185 | A1 | 6/2011 | Walker | |
| 2012/0100901 | A1 | 4/2012 | Kirsch | |
| 2012/0208615 | A1 | 8/2012 | Lancaster et al. | |
| 2012/0329543 | A1 | 12/2012 | Nicely et al. | |

* cited by examiner

READ AND WRITE PLAYING CARD SYSTEM AND METHOD

CROSS REFERENCE

The present patent application is a continuation of nonprovisional patent application Ser. No. 13/539,036 filed on Jun. 29, 2012 and entitled READ AND WRITE PLAYING CARD, which is a continuation of nonprovisional patent application Ser. No. 12/271,813 filed on Nov. 14, 2008 and entitled TABLE WITH INDICATORS AND SMART CARD HOLDER FOR AUTOMATED GAMING SYSTEM AND GAMING CARDS, which claims the benefit of provisional application 60/988,429, filed on Nov. 15, 2007 and entitled TABLE WITH SENSORS AND SMART CARD HOLDER FOR AUTOMATED GAMING SYSTEM AND GAMING CARDS, the present patent application and nonprovisional patent Ser. No. 12/271,813 filed on Nov. 14, 2008 are a continuation-in-part of nonprovisional patent application Ser. No. 11/838,230 filed on Aug. 14, 2007 and entitled SMART CARD HOLDER FOR AUTOMATED GAMING SYSTEM AND GAMING CARDS, all applications listed are hereby incorporated by reference.

FIELD

This invention is related to a read and write playing card system and method. More particularly, the invention relates to a system and method for reading and writing to a plurality of playing cards.

BACKGROUND

The discussion of any work, publications, sales, or activity anywhere in this submission, including in any documents submitted with this application, shall not be taken as an admission that any such work constitutes prior art. The discussion of any activity, work, or publication herein is not an admission that such activity, work, or publication existed or was known in any particular jurisdiction.

Schemes to fraudulently obtain money or credits from casinos or gaming houses by manipulating playing cards and/or credit devices, such as chips, are known. In one such scheme, a blackjack dealer may arrange with a co-conspirator to allow the co-conspirator to "win" large amounts from the house. Individual players have also devised unlawful schemes enabling them to "win" at various gaming tables including blackjack and craps. Still other schemes involve the theft or misuse or counterfeiting of playing cards. Manipulation and counterfeiting of gaming cards and/or gaming chips are one type of fraud that casinos must monitor. (The term "chip" as used herein shall be understood to encompass any type of gaming or casino-accepted currency, such as gaming chips, plaques, or jetons.) As a consequence of various schemes to manipulate playing cards and/or game results, casinos expend considerable time and effort in manually observing players, game operators, and other casino employees in an effort to make certain that all of the games are fairly played and that card holding, card passing or the use of unauthorized or counterfeit cards is kept to a minimum. Such matters as the amount of a player's buy-in, the time played, the average bet of the player, and a player's win-loss record are often tracked. Such techniques are labor intensive and only partially effective.

It is known to embed a radio frequency transponder in a gaming chip, and one such construction is shown in U.S. Pat. No. 5,166,502 to Rendleman et al. It is also known to track the flow and history of gaming chips through a casino. U.S. Pat. Nos. 5,735,742 and 5,651,548 to John French describe aspects of a system to monitor and record all gaming chip transactions in a casino using gaming chips with embedded transponders or RFID devices. This system is directed to reducing theft and fraud on the casino floor, while also reducing the need for large numbers of pit employees to manually monitor activities at the various gaming tables. In some implementations, gaming chips, jetons, and/or plaques have a body and a transponder carried within the body. The transponder is encoded with permanent read-only identification information and further includes a data bank for receiving and maintaining changeable information transmitted thereto from an RF antenna. The changeable information may include a voidable casino security code, so that a chip may easily be voided if fraud is suspected, as well as a transactional history of the chip within the casino.

Many different RFID technologies exist and continue to be developed. One or more of these technologies can be employed according to specific illustrative embodiments based on various design parameters. It would be understood to one of skill in the RFID art how to select and implement RFID components for use in a system according to specific embodiments. Some information regarding design and implementation of various RFID systems can be found at http://transpondernews.com and its linked web pages, as well as the references in the submitted information disclosure statement.

A number of methods are known for incorporating RF transponders in a flat object such as a product label. For example, the following United States Patent references discuss various RFID technologies, including, surface-printable RFID-transponders; flat-silicon RFID transponders; and RFID transponders that have read/write/erase capability. These references are provided as examples of technology that can be used to implement various aspects of the illustrative embodiments and are intended not to be limiting.

SUMMARY

A read and write playing card system and method is described. The playing card system and method includes a unique card identification that uniquely identifies the playing from other cards in the deck of playing cards, when activated by an electronic system. The read and write playing card also includes at least one playing card electronic component configured to receive data regarding game play, wherein the playing card corresponds to a deck of playing cards. Additionally, at least one of the playing card electronic components is configured to store data regarding game play, when activated by the electronic system. Furthermore, at least one of the playing card electronic components is configured to transmit the unique card identification, when activated by the electronic system.

In another embodiment system and method includes a deck of read and write playing cards, in which each playing card includes a unique card identification that uniquely identifies the playing card from other cards in the deck of playing cards, when activated by an electronic systems, a read component, a write component and memory storage are described. The read component is disposed on the playing card that is configured to be read during gaming play by an electronic system. The write component disposed on the playing card that is configured to receive data regarding card play during game play, when the writable memory is activated by the electronic system. The memory storage disposed on the playing card that corresponds to the write component and is configured to receive and store data regarding game play.

In one illustrative embodiment, the playing card includes an optical pattern on the player card that can further include a visible pattern and a human invisible optical pattern.

In another embodiment, the playing card stores a unique card identification that when activated by an appropriate electronic system uniquely identifies the card from other cards having the same suit and value.

In yet another embodiment, the playing card includes at least one area containing magnetically readable and/or writeable material. The playing card may also include at least one RF transponder component.

In a further embodiment, the playing gaming card includes at least one readable and/or writeable material and at least one RF transponder component. Additionally, the playing card is configured to interface with an electronic system that reads data from one of the components and stores information including the data on another card component.

In another embodiment, a permanent read-only identification information is associated with each playing card. The gaming card may also comprise a changeable transactional history stored on the playing card. Furthermore, the playing card may include a voidable casino security code.

The playing card may also communicate with a card holder configured to read and write to each playing card. The card holder may be configured to store a card suit, a card value, unique card identity, an identity of a player to whom the card is dealt, an identity of a previous card dealt to the player, an identity of previous n cards dealt from a deck, when n indicates any desired number of cards, a time when the card was dealt, or a beginning time of the game.

In some of the drawings and detailed descriptions below, the preferred embodiments are described in terms of operating on particular digital data systems. This should not be taken to limit the embodiments, which, using the teachings provided herein, can be implemented on a variety of different digital systems.

All references, publications, patents, and patent applications cited herein are hereby and cited in any accompanying Information Disclosure Statement are incorporated by reference in their entirety for all purposes.

DESCRIPTION

Figure 1:
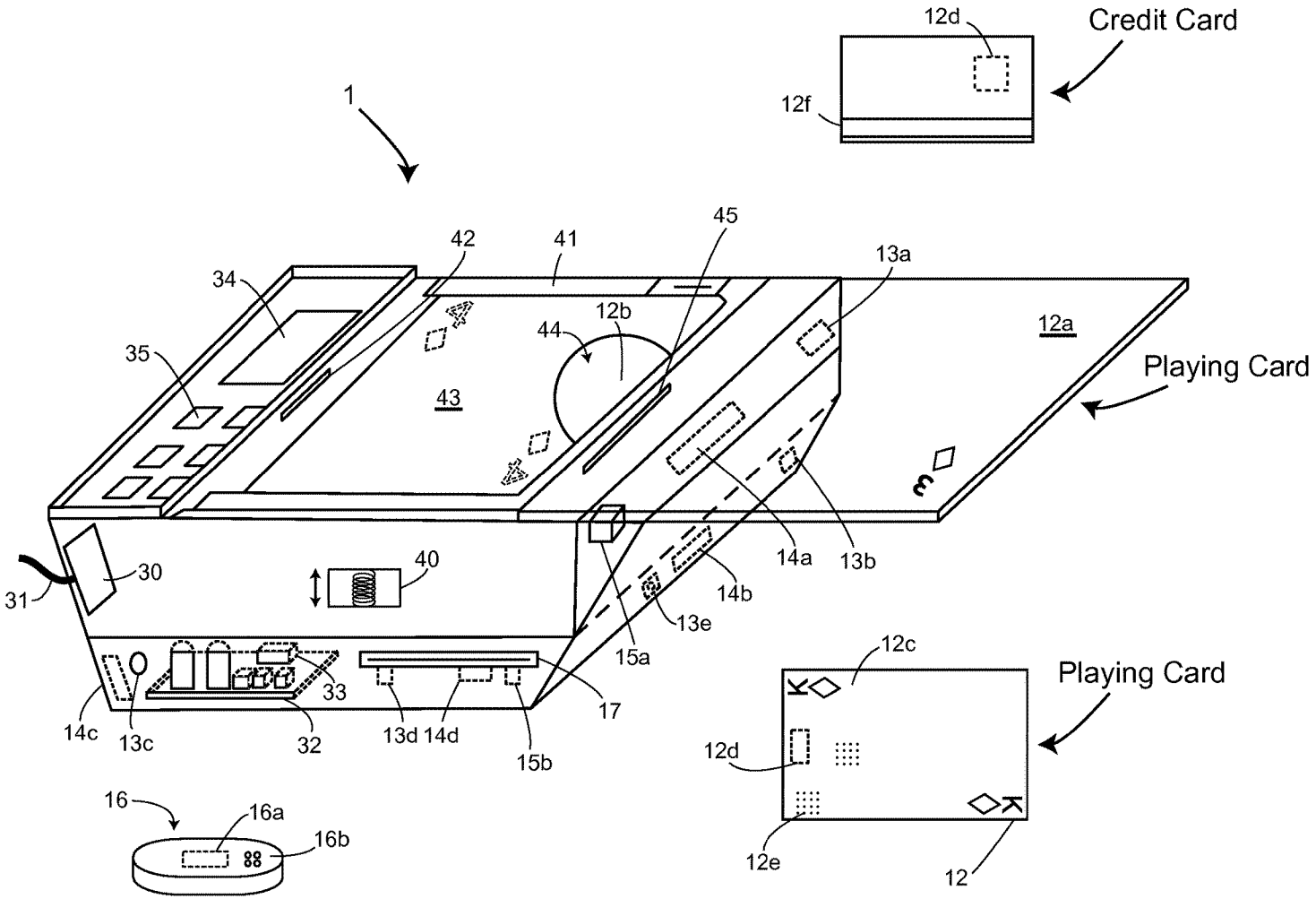
FIG. 1 shows an illustrative embodiment of a hand-held smart card holder according.

Persons of ordinary skill in the art will realize that the following description is illustrative and not in any way limiting. Other embodiments of the claimed subject matter will readily suggest themselves to such skilled persons having the benefit of this disclosure. It shall be appreciated by those of ordinary skill in the art that the systems and apparatus described hereinafter may vary as to configuration and as to details. Additionally, the methods may vary as to details, order of the actions, or other variations without departing from the illustrative methods disclosed here in.

Before describing the details of specific example implementations, various aspects, and advantages of the embodiments are described below. In this description, it should be understood that while some features are described specifically as related to a Hand-Held Playing Card Holder (HHCH), these features may also be present in specific embodiments that use a table playing card holder, which may be understood herein as any card holder or dealing device that generally remains on or adjacent to a gaming table and is generally or never held in a dealers hand above the table during game play. Furthermore, before describing the illustrative embodiments in detail, it is to be understood that these illustrative embodiments are not limited to particular compositions or systems, which can, of course, vary. It is also to be understood that the terminology used herein is for the purpose of describing particular embodiments only, and is not intended to be limiting. As used in this specification and the appended claims, the singular forms “a”, “an”

and "the" include plural referents unless the content and context clearly dictates otherwise. Thus, for example, reference to "a device" includes a combination of two or more such devices, and the like. Unless defined otherwise, various terms relating to gaming and/or electronic systems used herein have meanings as commonly understood by one of ordinary skill in the art to which the embodiments pertains. Although any systems and devices similar or equivalent to those described herein can be used in practice or for testing of the illustrative embodiments presented herein.

The illustrative embodiments are involved with methods and/or systems that facilitate card gaming. One embodiment illustrates playing cards that include an electronic data bank to which data can be written to and from, which data can be read, and/or that have a unique identifier. Further embodiments involve a card holder with apparatus that can read and write to playing cards and optionally interface with one or more other gaming components, such as chips, table electronic components (e.g., antenna), or table optical markings or indicia. Monitoring software or logic routines executing on a logic processor within or connected to the card holder accomplish various game and/or player tracking features and other automatic gaming operations, as discussed below. In specific embodiments, these logic routines control information that is written to a playing card data bank.

In further embodiments, a card holder interfaces with playing cards and optionally gaming chips that have radio frequency circuits (e.g., RFID or transponders) embedded within or attached thereto. In specific embodiments, a card holder can perform multiple automation tasks as described below with minimal or no additional modification to a game table, though in other embodiments the card holder can interact with game table optical marks or triggers and/or game table electronics/transponders. Thus the illustrative embodiments involve an intelligent card holding device that incorporates a variety of data sensing and transmission technologies that have not previously been incorporated within a card holder, creating a useful and economic system to automate or enhance game play at various casino table games.

Various casino-type card games can utilize devices that hold playing cards. Such devices are commonly known as card shoes. Table mounted card shoes can generally be categorized as one of two types: one type holds playing cards, which cards are removed from the card shoe by the card dealer. Typically, such card shoes have only one function and that is to hold playing cards. Another type of card shoe not only holds the playing cards, but also electronically scans playing cards to determine the cards' value. Generally, this scanning is done as the card is leaving the card shoe.

Generally, when using a card shoe, a playing card leaves the shoe with exactly the same data on it, either in printed or electrically or magnetically stored forms, as the card had when it initially entered the shoe. In shoes with electronic scanning, playing cards generally are scanned for a card's suit and value, though generally the cards are not scanned to determine each card's individual uniqueness. Existing card shoes generally are limited in their data exchange ability with playing cards or other game table components.

In some prior systems, playing cards used in table games are scanned by optical devices that are placed within and/or attached to playing card holders. Such scanners scan patterns on or within the playing cards, but these playing cards generally have no capacity to retain or store data during dealing or game play. Playing cards have been developed that have radio frequency transponders therein, but such playing cards generally have no capacity allowing a two way interface with various card holding devices including devices that shuffle playing cards and/or table mounted card scanners and such playing cards do not have the ability to store data that is written to them during card play.

Some casino table games utilize card-holding devices that shuffle playing cards. In some cases, these devices can include scanners integrated within and/or attached thereto to scan the playing cards and to count and verify that no cards are missing and that there are no counterfeit cards within the decks of cards being shuffled. Existing card shuffling machines generally have no features that allow them to erase data, transmit data, record data, and/or write data to the playing cards. Such card shuffling machines generally are not able to individually identify the uniqueness (fingerprint) of each card.

Electronic Interfaces

According to specific embodiments described herein, a card holder contains at least one type of data interface to exchange data with other elements. In specific embodiments, a system utilizes various types of electronic or optical interfaces between a card holder, playing cards, gaming chips, bet positions, dealer chip trays, players, card dealers, and casino data banks. In other aspects, embodiments of the system can include various optional components to automate casino table games, such as devices to automate player card requests for receiving and/or rejecting delivery of another playing card. The illustrative embodiments can monitor player's game activity to determine what complimentary gifts they are warranted to receive. The illustrative embodiments can also include sensors and logic to determine if players are using unwelcome playing strategies. In further embodiments, players' and/or dealers' card counts are totaled and displayed, and significant events related to those card counts, such as detecting and announcing when the card dealer has blackjack. Specific embodiments can also correlate bets (gaming chips) to playing cards and calculate win/loss/draw on such bets. A cardholder described herein can also incorporate or interface with one or more cameras to photograph players at a gaming table. An illustrated cardholder may record some or all details of game play to a playing card, generally as it is leaving the card holder, though potentially also when it is on the gaming table.

A card holder may be custom programmed to function with individual and various types of table games that may have various forms of interactive components that interface with the card holder. Such versatility creates an economic plus for a casino. A card holder described herein may interface directly and or indirectly with computer systems that wish to receive and or transmit data with the card holder. Such interfacing provide data exchange with various data banks related to a casino environment, such as security, credit, advertising, accounting, etc.

In further embodiments, the illustrated system utilizes various types of sensors and electronic circuits and software to scan, track, monitor, compute, and interface with electronic devices, and thereby enable the automatic operation of various aspects of casino table games. In various embodiments, the system can scan playing cards, scan gaming chips, indicate players' and/or dealers' win/loss/draw status, increase and/or decrease player betting positions, compute awards to players based on their playing activity, photograph individual players, transmit player images to casino security/surveillance departments and/or other authorized casino personnel and perform other functions as described herein.

In further embodiments, the system may activate table displays that indicate each player's win/loss/draw of their bets, and/or dealer's card count, indicate in the game of blackjack when a dealer has blackjack, or any other significant event that occurs such as indicating when a player has a winning/loss/draw on specific card combinations. According to further specific embodiments, a fully automated monitoring and accounting system for casino table games is involved.

In further embodiments, a card holder can also: (1) communicate with any suitable component when that component relates to a specific table activity; (2) scan and change the database contained in devices that utilize components that interface with the electronic components contained in and/or attached to the holder: (3) photograph players; (4) scan and monitor game operator (dealer) activity; (5) allow players to request extra bet positions to be displayed on a game table; (6) calculate and totalize players' win and loss of their game activity (7) calculate player awards (comps), players players' win-loss, and odds on players.

In order to more easily illustrate the general concepts and components of the embodiments, reference is made to FIG. 1. FIG. 1 illustrates an example embodiment of a hand-held smart card holder according to specific embodiments, including a number of optional components. While FIG. 1 illustrates a particular mechanical configuration with particular electronic components, it will be apparent to those of skill in the art that the illustrative embodiments may be embodied in a wide variety of different configurations of a card holder. According to specific embodiments discussed herein, a HHCH is a primary component for tracking one or more of (1) movement, deal, and/or totals of table game playing cards; (2) movement of bets, validity, or totals of table game radio frequency gaming chips; (3) movement, identify, requests and/or activity of table game participants such as players or game operators (dealers); (4) win/loss totals of table game players and/or a casino; (5) photographs table game players; (6) history of table game events.

Mechanical Components, Housing, Power, Logic Controller

In specific embodiments, an HHCH has mechanical components to facilitate holding and dealing playing cards. In one example implementation, a card holder 1 has a housing as shown. A mechanical spring loaded card pusher 40 pushes the cards towards card retainers 41 allowing the positioning of the playing card to be easily dispensed by a card dealer. Card retainer stops 42 are hinged to allow cards to be loaded within the card holder. Card cover 43 includes opening 44 from which a dealer can withdraw a card. In specific embodiments, card gate 45 is a card stop that can be activated by players' card request buttons or switches (the use of button or switch herein should be understood to indicate any device that can be activated with a finger touch or motion, such as a button, touch screen, or motion detector). With these mechanical components, a single playing card (such as 12*a*) can be dealt from the holder while the remaining cards (such as 12*b*) stay in the holder compartment. Cards can be dealt face up or face down, though face down is the more usual configuration.

According to specific embodiments, an HHCH includes one or more of several electronic components, as described below. These generally are powered by a power supply, such as 30, which may be rechargeable and/or replaceable, as is understood in the art, and optionally may be attachable to power cord 31 to receive power and/or for recharging. Logic processing electronics 32 provides the digital data processing ability to facilitate operation of the card holder. In terms of its overall electrical and central logic processing operation, card holder 1 can operate and be constructed in a similar fashion to any familiar portable electronic information processing device. Thus, a card holder can be constructed using any portable power supply (such as a battery) as used in portable computers or cell phones. Recharging can be by means of switching batteries, connecting to a power cord, placing in a cradle with recharge connections, or wireless induction, as understood for other portably electronic devices. Electronics 32 can include any logic processing devices such as generic microprocessors, customized microprocessors, RAM memory, ROM memory, interface circuits, ASICs, nonvolatile memory, hard disk storage, memory card storage and/or interfacing, etc. Such components are well understood as used in portable devices such as computers, cell phones, cameras, media players, etc. Electronics 32 also generally will contain one or more network interfaces 33, such as secure Wi-Fi, Bluetooth, or wireless Ethernet, that allow the HHCH to communicate with external data handling systems within the casino, also as will be familiar in the art.

Prior card holding devices, including holders that shuffle playing cards, contain electronic data interface components that utilize data interface cables that connect directly and or indirectly with various table and casino databases. Hardwired data connections and or cables restrict the portability of the table-mounted card holding devices. Thus preferred embodiments interface with external data bases and information systems utilizing radio frequency interfaces.

Machines that hold playing cards, including card shuffling machines, are powered by connections to the casino main power supply. If the main power supply fails, then the card holder can no longer function. Thus, in a preferred embodiment, a self contained power supply to electronic devices within and or attached to a HHCH, increases the capability of further automation of table games.

Output 34 can include a visual display screen or lights or audio speaker as known in the portable device art for presenting information to a user. Input controls 35 can include any type of touch-sensitive buttons or screen for receiving user input.

FIG. 1 illustrates a large number of different electronic components which are described below. Many of these are alternative and/or optional components and not all components illustrated and described will be present in all embodiments. One advantage of the illustrative embodiments is that multiple of these functions are brought together in an HHCH, allowing for enhanced automation and tracking of game play, as described below.

Optical Interface

As an example, FIG. 1 illustrates a holder having four optical scanners 13*a*, 13*b*, 13*c*, 13*d* placed at various positions of the card holder and a optional camera 13*e*. The optical scanners may be identical to one another or each may be a different configuration optimized for its various functions; for example, some of the optical scanners may be highly directional and others may provide wide angle or fish-eye views. Some optical scanners may be sensitive to different light frequencies, such as ultraviolet light or invisible infrared. This may be useful, for example, in detecting various gaming table trigger marks or optical patterns that are printed in UV reflective ink or infrared inks and or paints. Not all embodiments will include all optical scanners or in some cases any optical scanners. Optical scanning can include visible light scanning or laser enable scanning, such as bar code reading, or UV scanning.

Playing Card Optical Scanner 13*a* is positioned to be able to easily optically scan a card as it leaves the card shoe. Various patterns on the card may identify one or more of the cards suit, value, or unique identity and these patterns are read by the optical scanner and the data read is stored by electronics 32.

Table Optical Scanner 13*b* is positioned to be able to optically read events on a gaming table. Depending on the particular implementation, these events may include one or more of: trigger marks indicating a position on a table, deal of a card to a particular position on a table, and/or placement of chips at a position on a table. Various optical patterns, as will be understood in the art, can be placed on a gaming table, or playing cards, or chips to facilitate optical recognition.

Dealer Optical Scanner 13*c* is positioned to be able to optically read events on a gaming table generally below and behind the hand-held holder.

ID Card Optical Scanner 13*d* is positioned to be able to easily optically scan an ID card that is placed in slot 17. Such an ID card can include a credit card, player reward card, or player betting credit card. Data read is processed by electronics 32 and communicated with external systems, such as credit card processing systems, as necessary.

Camera 13*e* photographs players who are stationed at the gaming table. The signal to activate the camera may be derived from other scanners in the shoe or at the table. The various departments within the casino may interface with the HHCH to activate camera 13*e* located in and/or adjacent to the HHCH, said camera may take images of players, and send those images to desirable casino locations and computer systems. This can increases security by allowing photographs of players to be transmitted for analysis and also for specific player identification. Facial recognition system may be completely within the structure of the HHCH or conveniently located within desirable location within and or outside the casino. The HHCH may activate switches to initialize one or more cameras, (not located on or in the HHCH) to photograph game participants. This increases security by facial recognition of unwelcome table game participants and provides an economic plus for the casino. By placing a camera on a card holder, surveillance and/or facial recognition may be improved because the camera is positioned to get a better view of a player's face.

In specific embodiments, an optical scanner scans optical patterns that are inherent and/or printed on playing cards. Data read by the optical scanner may be interfaced with other data handling components as described further herein (e.g., one or more radio frequency (RF) transponders and/or one or more magnetic interfaces) to track game or table activity. In specific embodiments, the playing cards used may be of one or more configurations.

In other embodiments, optical scanning alone of standard playing cards may be used to identify individual playing card values at a table. For example, consider the case where a table uses five different decks of cards, each with a different design on the back of the playing card. In such a case, one or two optical scanners that can read the design on the back of the playing card as well as the suit and value on the face of the card, can uniquely identify each card dealt, even though there will be five cards with the same suit/value in use at the table. In further embodiments, optical scanning of playing cards may be used to identify individual playing cards at a table where an optically readable identifier has been printed on each card. Consider, for example, a casino that uses up to a million decks of playing cards in a given period. Each deck may be marked with an ink that is not visible to the human eye (for example an ultra-violet and or infrared ink) that identifies the deck. With a simple numbering scheme of, for example, 000000 to 999999 printed on the face or on the back of each card in a deck, every card in a casino can be uniquely optically identified because each card has optical markings indicating its suit and value and also optical marks indicating its deck, thus providing for unique identification of 52 million cards in a casino when using 52-card decks. Alternatively, each deck may have a visible pattern difference that is not discernable to a human viewer, but is detectable by an optical scanner according to specific embodiments. Thus, in specific embodiments, each playing card may have its own individual finger print that can be read optically.

RF Interface

As a further example, FIG. 1 illustrates four radio frequency (RF) transponders 14*a*, 14*b*, 14*c* and 14*d*. The transponders may be identical or each may be a different configuration optimized for its various functions. Not all embodiments will include all the transponders shown, and due to the wireless nature of the transponders, in some embodiments, the four functions described below will be performed by fewer or more transponders than shown.

Playing card transponder 14*a* is positioned to be able to easily read and write data using RF from a playing card as it leaves the card holder. Various technologies for RF transponders in flat objects such as playing cards are known. According to the illustrative embodiments, a playing card with a transponder is able to receive and store data and later transmit that data. Transponder data written to or read from the card can include, in various embodiments, one or more of the card's suit, value, unique identity, identity of player to whom card is dealt, identity of previous card dealt to that player, identity of previous n cards dealt from the deck, when n indicates any desired number of cards, time card was dealt, beginning time of the game, or any other data deemed useful to accomplish the various features and advantageous of various embodiments described herein.

Table Transponder 14*b* is positioned to be able to transmit and/or receive data from antenna or transponder devices on a gaming table. Depending on the particular implementation, these transponder devices may include one or more of: in or under table antenna, playing cards on a table, chips on a table, player identification cards on a table.

Dealer Transponder 14*c* is positioned to be able to communicate with antenna transponder devices below and behind the hand-held holder.

ID Card Transponder 14*d* is positioned to be able to easily communicate with an ID card that is placed in slot 17. Such an ID card can include a credit card, player reward card, or player betting credit card. Data read is processed by electronics 32 and communicated with external systems, such as credit card processing systems, as necessary.

Magnetic Interfaces

As a further example, FIG. 1 illustrates two magnetic read or read/write heads 15*a* and 15*b*. Playing Card Magnetic Head 15*a* is positioned to be able to easily read and or write data to magnetic particles on a playing card. These particles can be arranged in a strip on the surface or just underneath the face of a playing card or in the ink placed on the front or back of a playing card. optically scan a card as it leaves the card shoe. Various patterns on the card may identify one or more of the cards suit, value, or unique identity and these patterns are read by the optical scanner and the data read is stored by electronics 32.

ID Card Magnetic Head 15*b* is positioned to be able to easily read and/or write to a magnetic strip on an ID card that is placed in slot 17. Such an ID card can include a credit card, player reward card, or player betting credit card. Data read is processed by electronics 32 and communicated with external systems, such as credit card processing systems, as necessary.

The magnetic components read and/or write data to magnetic particles (such as ferrite oxide particles) that are inherent and/or placed on playing cards. In this embodiment, playing cards can have data magnetically written to them according to what may be deemed as useful to the card game, e.g., name of player and/or dealer receiving card, time card was dealt to game participant, etc. In specific embodiments, magnetic reading alone may be used to identify individual playing cards at a table. In such a case, each card may either be provided with unique identifying magnetic data prior to being placed in the shoe. Alternatively, a magnetic particle area on the card may be blank (as in a blank video or audio cassette tape) when first placed in a shoe, and identifying data may be written by the shoe onto the card during the deal from the shoe. In this embodiment, playing cards may be supplied to the casino in multiple identical decks, with each card in each deck having a blank magnetic particle portion (or blank RFID memory portion) that can be used for recording identifying data by a card shoe.

The magnetic components read and/or write data to magnetic particles (such as ferrite oxide particles) that are inherent and/or placed on playing cards. Data read by the magnetic components may be interfaced with other data handling components as described further herein (e.g., one or more radio frequency (RF) transponders and/or one or more optical scanners) to track game or table activity.

In further embodiments, optical playing card suit and value markings contain magnetic reading and/or recording particles allowing the cards suit and value to be read by the magnetic components of the holder. The magnetic components can record a variety of information related to the table card game onto the playing card, e.g., identity of player receiving the card; time when player received the card; identifying the bet position where card will be placed, such as split cards, extra bets areas, the value of bet and the values of the cards dealt to specific game participants placed relating to cards being dealt to player or dealer, etc. Magnetic particles on playing cards may be placed in any convenient area on the playing cards.

In further embodiments, optical scanning is used in conjunction with magnetic writing to playing cards so that a card's suit, value, and/or other pertinent information is determined by the optical scanner, and that data is written to the playing card along with other identifying data. Such a system allows the playing card to be identified by a read/write magnetic head and/or an optical scanner. In such a system, a shoe described herein can exchange data between two different interface methods, such as reading a card identity optically and then writing that data electronically.

In further embodiments, a shoe is associated with a magnetic read/write head or a transponder that can interface to players' credit cards, identity cards, award cards, etc., such as 15*b*. This read/write head can allow game data to be written to or read from these cards. In specific embodiments, the read/write head may be the same head used for reading and writing playing cards. In other embodiments, a separate head either included on the shoe or mounted elsewhere on the table is used. In some preferred embodiments, a reader is incorporated with a portable HHCH to reduce costs and complexity of the system.

A number of methods are known for incorporating magnetic particles that can be read and written into flat card-type objects, such as plastic credit cards, paper or cardboard mass transportation fare cards, etc. Various methods for adapting any of this preexisting technology to playing cards will be understood to those of skill in the art having benefit of the teachings provided herein. Magnetic particles in playing cards have been used in the past; but they have not been interfaced as in the illustrative embodiments.

In some applications, a card holder can contain a direct electronic interface rather than or in combination with magnetic heads. This interface most commonly could be used with a ID card or ID dongle. In this use, a dongle is any hardware device used for identity authentication or credit. Dongles may be incorporated in "USB-key" type device, in which case the present illustrative embodiments may include a USB interface in addition to or instead of magnetic head 15*b*. A memory interface may also be used for playing cards with incorporated non-wireless memory.

Interfaces in Combination

An important aspect of an HHCH, according to specific embodiments, is that data from any of the interfaces shown in FIG. 1 can be freely exchanged between the interfaces and can be stored, operated upon, or transmitted outside of the HHCH by electronics 32. For example, data read by the magnetic components may be interfaced with other data handling components as described further herein (e.g., one or more radio frequency (RF) transponders and/or one or more optical scanners) to track game or table activity.

Another important aspect of an HHCH, according to specific embodiments, is that the presence of multiple interfaces in the HHCH that all can interact with the card play and bet tracking logic such as running on logic circuits 32 allows an HHCH to be flexibly deployed in different casinos situations. In instances where a casino does not use RFID playing cards, due to cost, for example, an HHCH according to illustrative embodiments can perform many of the desired functions using a magnetic strip on a playing card. Should the casino at a later time or on a different table use RFID playing cards, an existing HHCH with multiple interfaces can then begin utilizing those RFID components. Similarly with playing chips in that an HHCH, according to specific illustrated embodiments, can detect the positions and/or values of chips optically where chips do not have RFID transponders or an HHCH according to specific embodiments can interact with RFID chips when those are present.

Playing Cards

Figure 2:
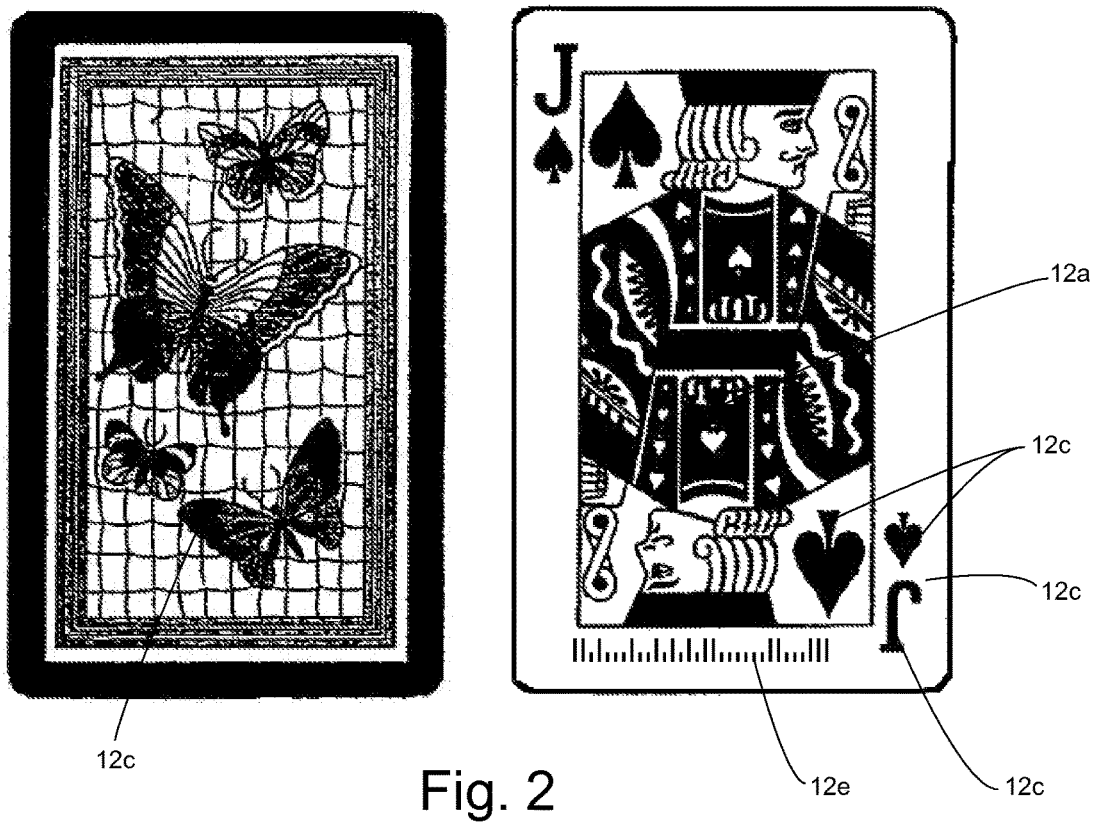
FIG. 2 shows an illustrative playing card.

According to specific embodiments, an important feature of playing cards is that they provide a means to be uniquely identified by one or more automatic scanning devices at a gaming table. This means may be permanently incorporated into a playing card, such as using bar codes, visual pattern, or read-only electronic data. In such a case, a playing card may not include a feature of being written to during game play. In a preferred embodiment, playing cards include a writable memory, such as a magnetic particle area or a transponder with a memory storage. In such a case, a unique identity may be written to playing cards as they are handled or dealt at a table and further data regarding tracking card play can also be written to the playing cards. FIG. 2 illustrates one example of a playing card with components according to illustrative embodiments. In specific embodiments, cards 12 include visually perceptible patterns such as 12*c* that are historical elements of playing cards (e.g., suit and value on the face of the card and deck pattern on the back of the card). In specific embodiments, these patterns are printed with a color and/or contrast and/or shape that makes them easily read by an optical reader incorporated into a shoe. In further embodiments, cards may have printed on their face an optical pattern such as a bar code 12*e*, which uniquely identifies that card from any other card of the same suit or value that may exist in the casino. In some embodiments, this identifier may be embedded into a pattern that is not easily perceived or easily read by a human viewer. In other embodiments, this pattern may be easily recognized by a human viewer, but because the pattern only appears on the face side of the card, it is not possible that the human viewer can detect or recognize the pattern until the face value of the card is revealed.

In other embodiments, a unique pattern may be placed on the backside of a playing card. In this case, in particular embodiments, it is important that the pattern not be "readable" by a player. This can be accomplished by including the pattern in a set of dots or rows that may appear not to contain identifying information to a human viewer, but that can be optically read by a card holder. In further embodiments, optical patterns 12*c* can further include magnetic particles to make the patterns electronically readable to card shoe, but generally not to a human viewer, and also in further embodiments, to make the cards writable by the card shoe. These magnetic particles can be printed or embedded into various areas of the card so as to make them visually indistinguishable from other card patterns. As discussed above, these patterns can permanently convey one or more of at least three items of information: (1) the card suit; (2) the card value (3) a unique identification of the card to distinguish it from all other cards that might be present in the card game and or casino, which in some situations can be upwards of many millions of different cards. In further embodiments, the magnetic particles can be configured to store data placed on them by electronic writers in the card shoe or elsewhere in the system. This data can include such information as when the card was played from the shoe, the identity of the player to whom the card was dealt or played, the card-related bet position and identifying information regarding the card, such as the table at which the card was played or a unique identification for the playing card. Magnetic particles can also be embedded into a magnetic strip such as shown in FIG. 1 credit card 12 magnetic strip 12*f*.

In further embodiments, playing cards can also include radio frequency transponder 12*d* embedded within the card. These transponders can either substitute for magnetic particles or work in addition to them. Where present, transponders 12*d* allow a card to send and/or receive data from the card shoe and also from other positions on the table. Transponders 12*d* can be implemented by various flat transponder technologies that are known in the art or by other transmit/receive technologies, such as smart dust. RF transponders can also include RF microchips, and/or printed RF transponders and alternate methods of providing suitable RF transponders.

A read/write playing card, according to specific embodiments, with a two way interface to a smart holder allows for more complete tracks of playing cards for greater security and game automation. This allows more card games to be played within a specific time period, which is an economic plus for the Casino. The system also allows sequence scanning of cards (e.g., the first card dealt to a player may be a 3 of diamonds, the second card to the same player may be a 5 of hearts, the second card would contain the data received from the first card, plus the second card reading and also contain the total value (history of cards dealt) to a specific game participant) and in further embodiments allows correlation of bets with playing cards.

Other Devices

Further illustrative embodiments may be employed as part of a system that includes other gaming devices that interact with a card holder and/or playing cards described herein. A description of example devices is provided below, though other devices may be used in various implementations.

Chips

As described above, technologies for incorporating RAN RFID transponders into gaming chips are known. An example of such a chip 16 with transponder 16*a* and/or electronic dust 16*b* is shown in FIG. 1. In particular embodiments, such chips may be read and/or written to by a holder and may interface with other devices as described herein.

There are table game monitoring systems that utilize gaming chips that have embedded radio frequency transponders, said gaming chips are scanned by stationary antennas placed underneath the gaming table, each participant in the table game have their own dedicated antennas which monitor their gaming chip activity. While this system worked for scanning gaming chips when they are placed above each participant's area of chip placement, it does not lend itself to scanning radio frequency gaming chips in areas where there are no antennas placed underneath the gaming table.

According to illustrative embodiments, the radio frequency transponders within or attached to the HHCH may scan gaming chips that contain radio frequency transponders and determine values for each gaming chip, and create a total value of all gaming chips scanned within specific areas, such areas may be where players place their bets and also where dealers place their bankroll of gaming chips. In a specific embodiment, a read/write transponder within or attached to the HHCH may interface with transponders, such as in-table or chip-tray transponders, that are located near gaming chips. Alternatively, an HHCH transponder can alone scan all gaming chips.

Game Table

In specific embodiments, a gaming table 20 can have one or more components that interact with other devices in a system described herein. Table optical markings or indicators, such as bet area borders, or optical spots described below can be used that allow the HHCH to determine by optical scanning various table events and activities such as to which player a card is being dealt and to perform other functions related to the table game. In further implementations, optical patterns are placed at strategic positions on a gaming table to allow an optical scanner to track when bets are placed, when a dealer chip tray is in place, etc.

In further embodiments, a table contains one or more transponders that can communicate with the shoe and/or playing cards and/or player identification cards and/or chips. Table transponders are placed on or in or under the table game surface, such interfacing allows the table game transponders to communicate data such as one or more of: player identification, player bet positions, player cards received, player requests for playing cards, player bet information, player requests for extra bet areas, players side bet information, player bet counts, dealers (game operator) bet count, plus dealers announcement of significant events such as dealer having blackjack, etc.

Techniques for incorporating transponders into gaming tables and/or for providing optical markings or triggers are known in the art.

Electronic devices within and or attached to the HHCH, may be optically triggered by table marks placed in and/or attached to the gaming table. These marks trigger optical sensors within and or attached to the HHCH, which in turn activate Radio Frequency antenna and or antennas within the HHCH, thereby allowing those devices to scan gaming chips that contain radio frequency transponders, which are placed within the boundaries referenced by said table optical marks.

Table trigger marks may also identify specific game participants where each game participant position has dedicated optical marks and or markings.

Game Play Operation

Figure 3:
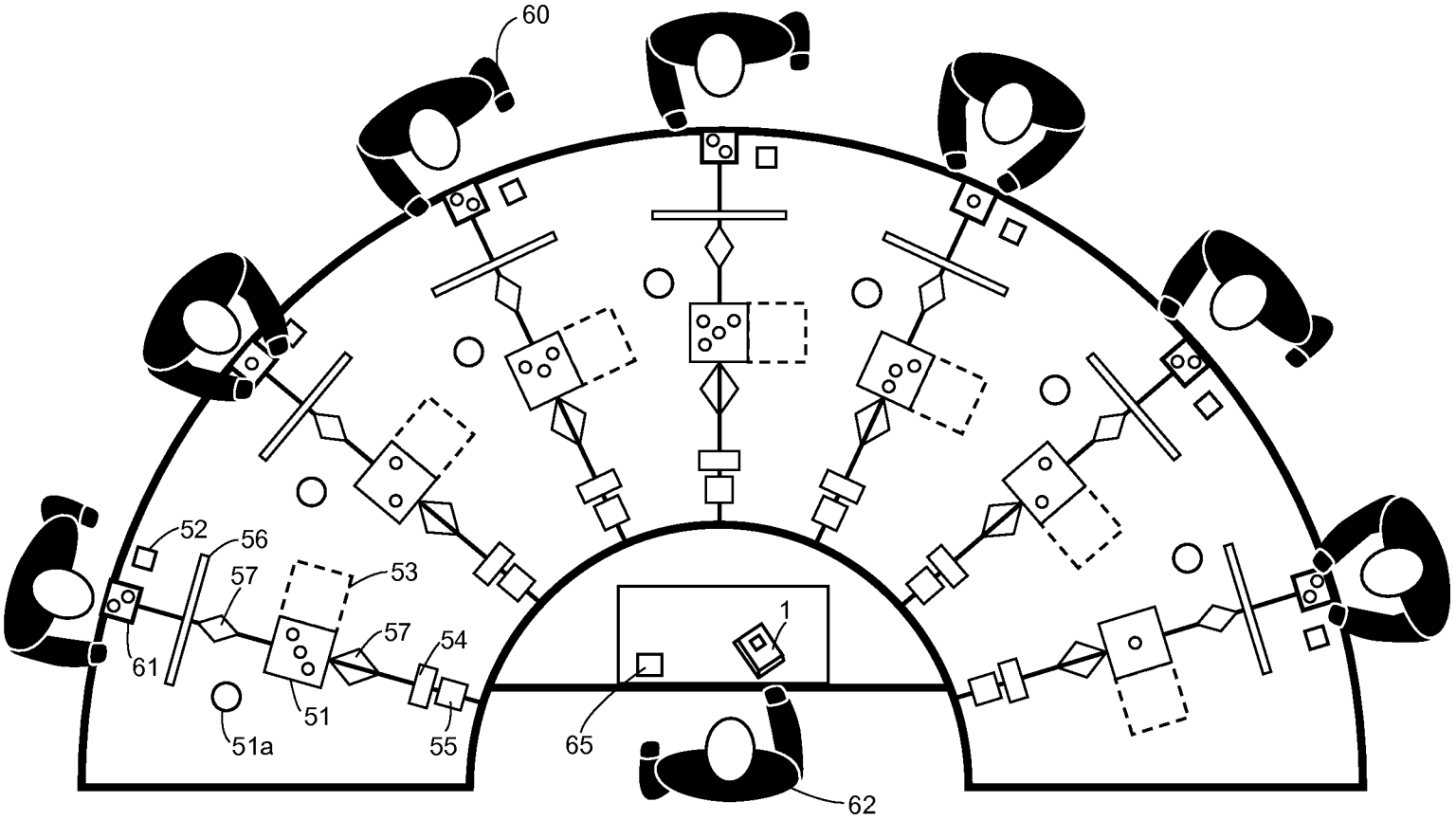
FIG. 3 shows a top view of an illustrative game table with a card holder at one player position.
Figure 4:
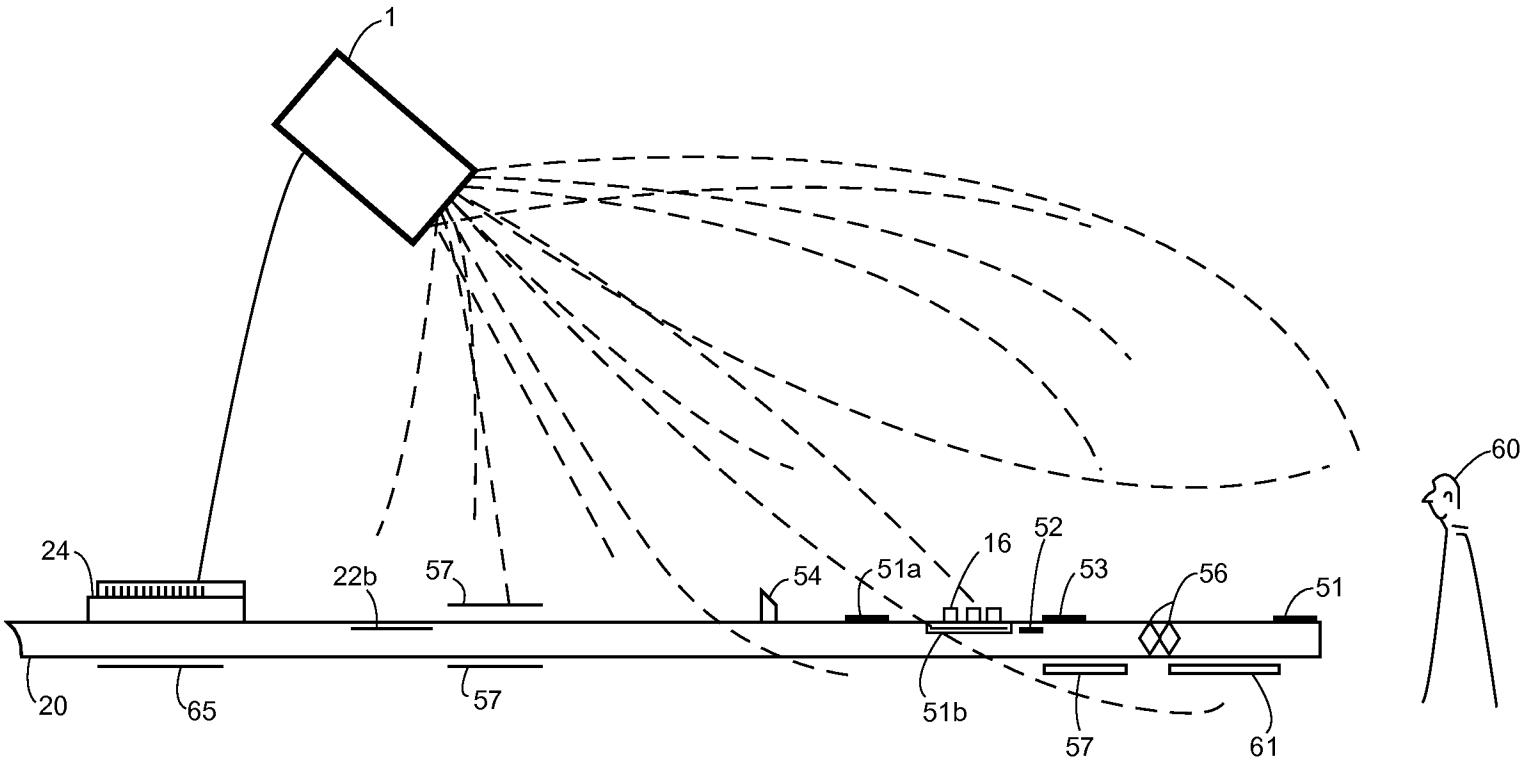
FIG. 4 shows an illustrative side view of a game table including a card holder and illustrative wireless data communication between elements.

FIG. 3 is a top view illustrating one example of a game table showing a card holder, according to illustrative embodiments, and other table elements, with a detailed description of the elements present at one player position. This figure illustrates the multiple channels of communication that can take place between a hand-held card holder and various table components. The figure also illustrates that the position of the HHCH above the able allows the holder to more easily gather information from cards and/or chips and/or other components. FIG. 4 is a side view illustrating one example of a game table showing a card holder according to specific embodiments and other table elements, with a detailed description of the elements present at one player position and showing examples of wireless data communication between elements. For illustrative purposes, FIG. 3 shows seven players 60 and a dealer 62. As described above, a card holder in such a table game includes intelligence and components that allow reading, writing, and tracking of cards at a gaming table either alone or with other table electronics as shown.

Various example components are shown in FIG. 3 and FIG. 4 to facilitate operation according to illustrative embodiments. It will be understood that not all components shown will be present in all embodiments.

Card Tracking

In specific embodiments, an important component of game automation, is tracking and storing a history of play of gaming cards. Using FIG. 1 as an example, game playing cards 12 are scanned or read by at least one of the interfaces described above as they are dealt to a player. In preferred embodiments, at a minimum, a card holder stores the unique identity of each playing card and the player to whom the card is dealt. In further embodiments, a card holder stores the time that each card is dealt. In some embodiments, this data is stored on a storage media by electronics 32. In other embodiments, this data is stored on magnetic particles or a transponder memory of each playing card as it is dealt.

Thus, illustrative embodiments described herein are able to track an individual playing card so that an unscrupulous player cannot hold it for next game or keep it. In specific embodiments, the holder itself can determine and record on a playing card identifying information such as when it was dealt, the player it was dealt to, etc. Thus, even with a holder-only implementation, a playing card can be tracked to determine if a player retained that card fraudulently or passed it to a friend or accomplice at a table. However, with a table interface, an HHCH can determine that a card was delivered to that a specific area. The illustrative embodiments also check for counterfeit cards or from cards that have been introduced from another table or held from a previous game.

Thus, while in some earlier stationary card shoes, card readers are placed in stationary card shoes with a playing card with a transponders in them and optionally with an antenna under the table, in these systems cards are only read by components of the table. In the illustrative embodiments, components in or on the table can write to the playing cards, which can be tracked, modified, and/or encoded by the shoe or table.

Returning to FIG. 3 and FIG. 4, card tracking can also be accomplished using other components, such as table player identification area 61, where a player can place an identity card or other identity device. These are interfaced to card motion sensors 56, which in specific embodiments assists the playing card holder to receive signals to recognize a specific card. In further embodiments, one or more table transponders 57 interface with player main bet area 51 and player's optional second main bet area 53, and side bet area 51*a*. Each of these areas also may have their own transponders. In a table system, each of the components shown can be in communication with other table components and a card holder.

In further embodiments, a holder described herein interfaces with a player input 52, which is a mechanical and/or electronic means for a player to indicate a card request and optionally for that request to be transmitted and/or recorded e.g., via a transponder or via a conducting electrical connection. Area 61 illustrates an optical and/or electronic means for player identification and optionally for that identification to be transmitted and/or recorded e.g., via a transponder or via a conducting electrical connection. This area can also serve as an area for player chips to be held. 51 illustrates a main bet area; 51*a* illustrates a side bet area; 52 indicates optical triggers on a table that allow a hand-held holder to detect table activity; 53 illustrates an optional second main bets area; 54 illustrates optional player displays; 56 illustrates card motion sensor and card interfacing sensing, which, according to illustrative embodiments, can read RF transponders in playing cards and/or credit cards or player identification cards; 57 illustrates two further player transponders; 65 illustrates a dealer transponder.

FIG. 4 is a side view illustrating one example of a game table showing a card holder according to illustrative embodiments and other table elements, with a detailed description of the elements present at one player position and showing examples of wireless data communication between elements. In addition to elements described above, FIG. 4 also shows an additional in-table antenna 22*b* and a dealer chip tray 24.

Card Requests

It is not uncommon for a player to request another playing card by a hand signal and upon receiving another playing card, then deny they requested another card, and/or the dealer misinterpreted their hand signal. Table game players utilize various hands signals that are interpreted by the dealer as indicating the player wishes to receive or declines to receive another playing card to their existing hand of cards. Players often give confusing hand signals, and the dealer is often accused by the player that the dealer misinterpreted the player's hand signal. Additionally, illustrative embodiments may interface with a button or switch or motion sensor, such as 52, at each player's card receiving area. Other embodiments optionally include a motion sensor switch or touch switch that a player may used to make a card request. If player wants a card, a card request switch, or button, or motion sensor interfaces with a hand-held or table-mounted card holder to indicate that the player has requested a playing card and can record on the card that the player actually received it. This can help prevent or resolve disputes such as when a player asserts that they requested or did not request a particular card after the card is dealt. In such disputes, time is wasted and enjoyment of play can be diminished for other players and stress can be increased on the dealer. According to specific embodiments, the system records that a player, for example, activated a card request motion sensor or touch switch. Thus use of a positive indicator such as a player card request at a gaming table along with a shoe that can record card play in another novel aspect according to illustrative embodiments. Requiring the player to activate a switch when they wish to receive a playing card eliminates the confusion created by disagreements between the player and the card dealer, as the players switch activation is recorded for future reference, and no hand signal interpretation is required by the card dealer. This feature allows more games to be played within a specific time period, creating an economic plus for the casino, and reduces disputes and opportunities for participants to cheat. In specific embodiments, such buttons may be to some extent portable or easily attachable to an existing table and interact with the HHCH, thus allowing this functionality with little or no table modification.

In further embodiments, the playing card holder radio transponder may interface either electronically or via RF communication with various players requests related to a game, e.g., a player requesting another card, requesting more bet areas, (such as having another main bet area, similar to playing more than one hand of cards), and/or placing side bets, or splitting one hand of cards into two separate hands of cards etc.

In further embodiments, an HHCH contains a method to dispense and/or not dispense playing cards to players, by receiving a player's request signal and thereby appropriately activating a hinge, or card stop, or card gate to allow a card to be dealt. For example, a player-activated switch may send a radio frequency signal or other signal to the HHCH and this signal activates directly and/or indirectly a playing card feed mechanism, which allows the dispensing and or partial dispensing of the playing card.

Holder electronics can further activate a visual signal (using a display or light element) or an audio signal to the card dealer that the player wishes to receive a playing card, the signal received by the electronics within the HHCH, may also activate a mechanism that will allow the Dealer to manually dispense a playing card to the player.

In specific embodiments, a player switch may activate a drive roller within a hand-held card holder to deliver a card to the specific player. An HHCH can include motorized ejection of the playing card, partial motorized dispensing of the playing card with final removal by manual action, removal by manual action with a block that is lowered only when a card has been requested, or total manual removal of the playing card from the HHCH. Some embodiments that are intended for manual removal of the playing cards will not include a motorized feed system.

Table Displays

In specific embodiments, a card holder interfaces with various table displays to display data relating to players running card count, player win/loss/draw outcome position, side bet win/loss/draw outcome, game dealer operators significant card count display, etc. Displays are optional in specific embodiments and inform players about their running card counts, and also, in the case of blackjack, if the dealer has a blackjack hand of cards by automatically counting the cards a dealer receives. Thus it is no longer necessary for the dealer to manually place his or her cards in a dealer-dedicated table-mounted card reader device to determine if they have a blackjack. By players having their displayed card counts, and game operator displaying if they have a blackjack, the table game is speeded up allowing more games to be played within a specific time period. As with the buttons or switches above, such displays may be "portable" or easily attached to an existing table and interact wirelessly with the HHCH, thus reducing modification necessary for an existing table.

Certain games and game events may be displayed that are related to game participants and activated by the HHCH to each and or all the game participants during a game. These events may include being displayed on a small display in front of a player that shows a total card count of the player's hand, and also the total count of the dealer's hand at the appropriate time of game formats. The displays may also be placed at various positions within the casino at the discretion of the casino, for example a casino may wish to place displays in certain areas for observations of game activity. Any event that is recorded by the HHCH and or its interfaced devices, if chosen, may be displayed to those dealers, players, and casino operators.

In addition, illustrative embodiments may change table displays in cases where a table bet area may be electronically indicated according to requirements of the table game, for example, a player may wish to have more than one bet position, and the HHCH can interface with displays to increase and or decrease player bet positions.

Automatic Card Count

In most casino games, players and card dealers have the responsibility to count the playing cards they have received. It is not unusual for players or dealers to miscount their cards, which may cause interruptions of the card game. In general, existing table electronic systems do not display a player and/or dealer card counts. Specific illustrative embodiments address this by providing card counts to each player at their table display. In games such as blackjack, the ace card may be counted as a one or eleven. Very often players find it difficult to determine the playing hand total when they have the choice to count the ace as a one or eleven. Thus, in specific embodiments, a player card count display showing both totals, using the ace as an eleven, and another showing the ace as a one, provides players with an easy reference regarding their card count. Furthermore, in blackjack, when one of the dealer's first two cards shows a ten, jack, queen, king, or ace, the dealer is required to place their non-exposed card under a device that allows the dealer to determine if he has 21 (blackjack), which is then announced to all the players at the table. With this determination made automatically by the illustrative embodiment, manual labor and dealer error are reduced, increasing the amount of card games that can be played within a specific time period.

Thus, in further embodiments, speed of game play is facilitated by providing a digital and/or audio count for a player as or after a card is dealt. In this situation, play can be facilitated because players sometimes have trouble or are delayed in counting their cards. Dealer announced card counts increase fatigue on the dealer and introduce the possibility of human error by the dealer. Thus, in specific embodiments, mistakes or delays caused by the dealer miscounting the cards or players miscounting the cards or being very slow in counting cards are reduced or eliminated.

Data Transmitted to Other Casino Systems

The HHCH may transmit data regarding the win/loss/draw of players and the history of their betting activity including a facial image, which provides the casino with a table game history and a photograph of each table game participant. The knowledge of player's activities at the gaming table allows the casino to calculate what rewards (comps) a player is awarded. This is an economic plus for a casino, as it avoids a great deal of manual labor by the casino. In specific embodiments, an HHCH can include antennas and/or transponders and/or detectors that allow the HHCH to interface with any desired object that has specific wave lengths suitable for interfacing to the HHCH.

Chip Tracking

HHCH may include a transponder that can read chips and/or identification cards directly without table antennas or can read chips in combination with one or more table antennas/transponders. In specific embodiments, the HHCH can totalize the value and identification of each gaming chip and relate determine the specific areas where detected gaming chips are placed. In various embodiments, gaming chips 16 (shown on FIG. 4) may be scanned by chip area transponders, and/or table transponders, and/or HHCH transponders. Transponders generally can read/write/erase data to gaming chips 16 as directed by HHCH electronics. Card holder transponders may interface with any device within the casino that has suitable data interfaces, including with each other and also playing card transponders and chip transponders. One or more table transponders can be positioned on the table to interact with gaming chips or player credit or identification cards. Data detected by these transponders is exchanged with, for example, transponder 14*b*. Table transponders may also interface with suitable interfaces that are not dependant on the HHCH.

Cameras and/or other optical sensors can also be used to scan gaming chips by identifying markings on individual gaming chips. However, they generally require a line of sight to the gaming chips, and they are not suitable to scan gaming chips for authenticity, as all individual markings only indicate the value of a gaming chip and are not suitable to identify individual gaming chips for individual fingerprints. The illustrative embodiments can recognize RFID gaming chips' unique fingerprint, therefore checking that each gaming chip is authentic. Where RFID gaming chips are not used, however, an HHCH allows easier optical scanning of chip values and chip placement as the HHCH is held in the dealer's hand.

Bet Tracking

Thus, with the ability to track chip placement and table game activity, in further embodiments, an HHCH scans and monitors the amount bet by each player, scans playing cards dealt to specific players, and correlates bets with playing cards, thereby determining whether an individual player had a win/lost/draw outcome of their play. By receiving and storing what player receives specific playing cards, how much each player bet, a history of game participants' significant events, and a time record of significant game activity relating to all game participants, and other data as discussed herein, casino manual labor is reduced, which is an economic plus for the casino. In various embodiments, real-time accounting of a casino's win/loss position at one game or at many games, and of an individual player's win/loss position may be provided or displayed to a player or used by the casino. An HHCH also facilitates the tracking of side bets. Table game automation can be programmed for specific table games and variations thereof.

In embodiments where card activity information is correlated with the amount of gaming chips placed by the player in their bet placement areas, an HHCH may collect data from multiple gaming table antennas and/or transponders that are placed in relevant areas to interface with chips. In various implementations, table activity may be detected and/or recorded in both the table transponders and the HHCH Transponders. Each game participant and their position at the gaming table may be identified. Table game chip storage areas may also be identified.

Bet tracking, according to specific embodiments, is important because players have been known to fraudulently reduce or increase their bet amounts during a time period when no more betting activity is allowed. Generally, detecting this player cheating requires costly casino manual labor, as present card holder systems generally do not automatically recognize out of time player activity.

In some embodiments, areas wherein players place their gaming chip bets may be identified by optical table markers that are scanned by the optical sensor contained within and or attached to the HHCH.

As discussed herein, an HHCH can scan and/or have a two-way data interface with players' identification cards, credit cards, credit tickets, dongles, promotional documents, etc. An HHCH can hold one or more decks of playing cards, can scan, and also has the option to transfer data to playing cards. An HHCH, according to specific embodiments, has read and write functions, allowing said card holder to scan/read and record and/or erase data to playing cards thereby giving each playing card its own unique fingerprint. The system records that a specific player receives a specific playing card.

Side Bets and Split Bets

In some card games, players at times have the option to place a side bet, which is a separate bet from the main game. Side bets often have different rules than the main game and are bets that an event will occur related to cards dealt to the main card hand. If a winning event occurs related to the side bet, then the dealer pays the winning side bet. These side bet winnings may have various odds related to specific cards dealt to the player's main card hand. Generally, not only does the dealer have to be aware of the player's main card hand, but also the dealer has to determine the odds paid to the various combinations of winning events on the side bet. While side bets can be lucrative to a casino, they also take time from the playing of the main card game.

In further embodiments, side bets, such as are sometimes allowed in blackjack, are facilitated. In blackjack, for example, these side bets are separate from but connected to the main bet. In a side bet, the main bet can go bust, but the player may win the side bet. The side bet remains active until the bet status is determined and closed. The illustrative embodiments ease tracking and accounting for side bets for dealers and players alike. Having an automated side bet accounting system saves on manual labor cost and speeds up overall game play.

In a similar fashion, illustrative embodiments facilitate split betting for blackjack. When a bet is split, that information is communicated immediately to the shoe, and the shoe tracks each card dealt to each position of the split. A split bet may be detected by detecting the game activity, e.g., a player or dealer actually separating an identical pair of cards into two positions, or it may be input by a player or a dealer through one of the input devices associated with the system. An HHCH will always be aware of the possibility of a split bet, as it is tracking each card dealt and is programmed to recognize situations in which bets are allowed to be split. An HHCH may provide an indication to a player that a spilt is possible, either audibly or with a visual display.

Strategy Detect

In some instances, a player at a gaming table may have a specific playing strategy that, while not fraudulent or cheating, is not allowed by the casino. For the casino to monitor a player's unwelcome strategy, various devices are used to scan dealers and or players cards. In most situations it requires casino employees to monitor the activity of the player to detect any unwelcome card strategy that player may be using. Late observance and or detection of unwelcome card strategies are a concern to casinos. The specific embodiments described above can be programmed with logic that uses one or more of: player identification, identifying players' cards, identifying players' bets, recording time played, and other player and dealer significant events to detect disallowed strategies. This increases security and allows less manpower necessary to monitor player and dealer activities.

On-Table Holder

Figure 5:
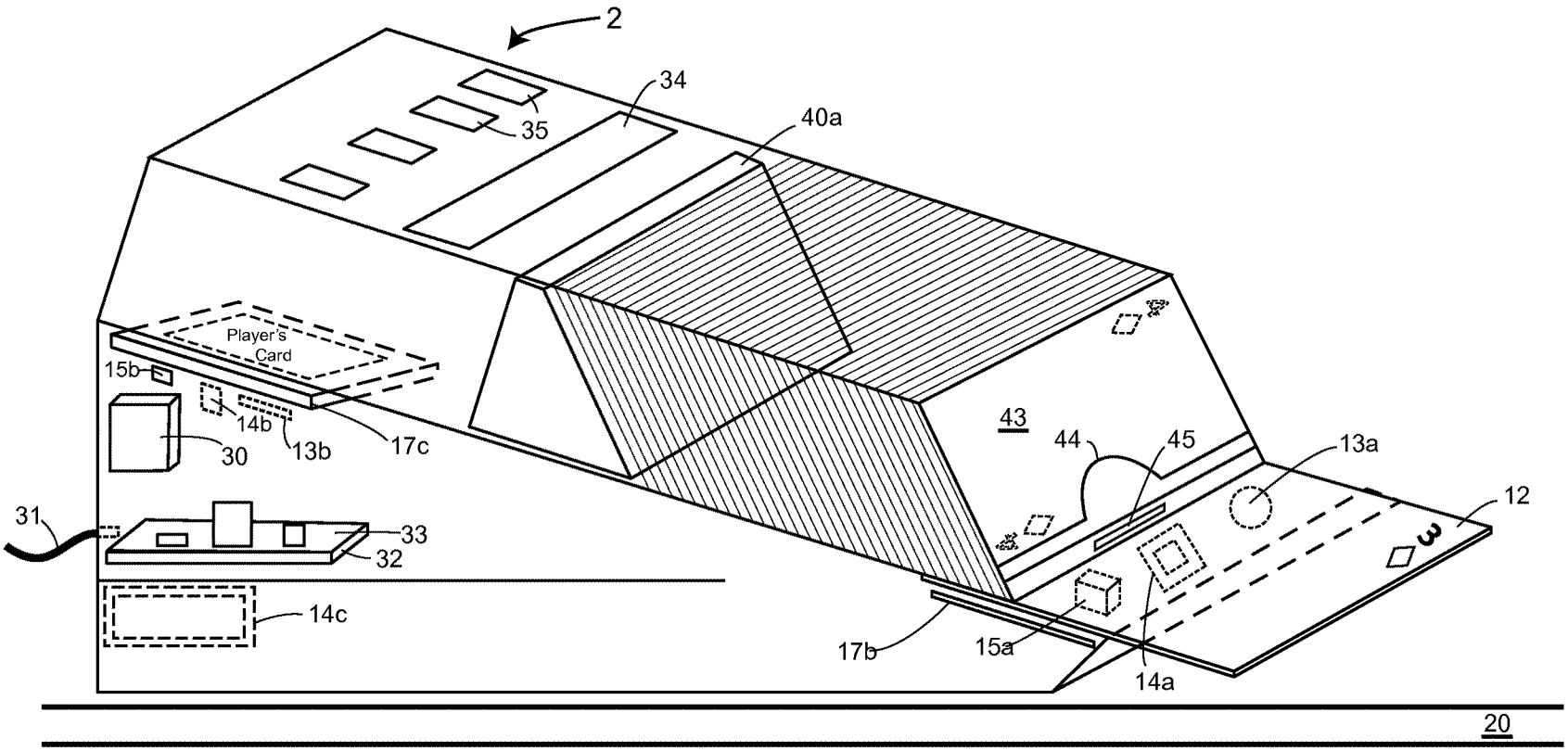
FIG. 5 shows an illustrative smart card holder positioned on a table during game play.
Figure 6:
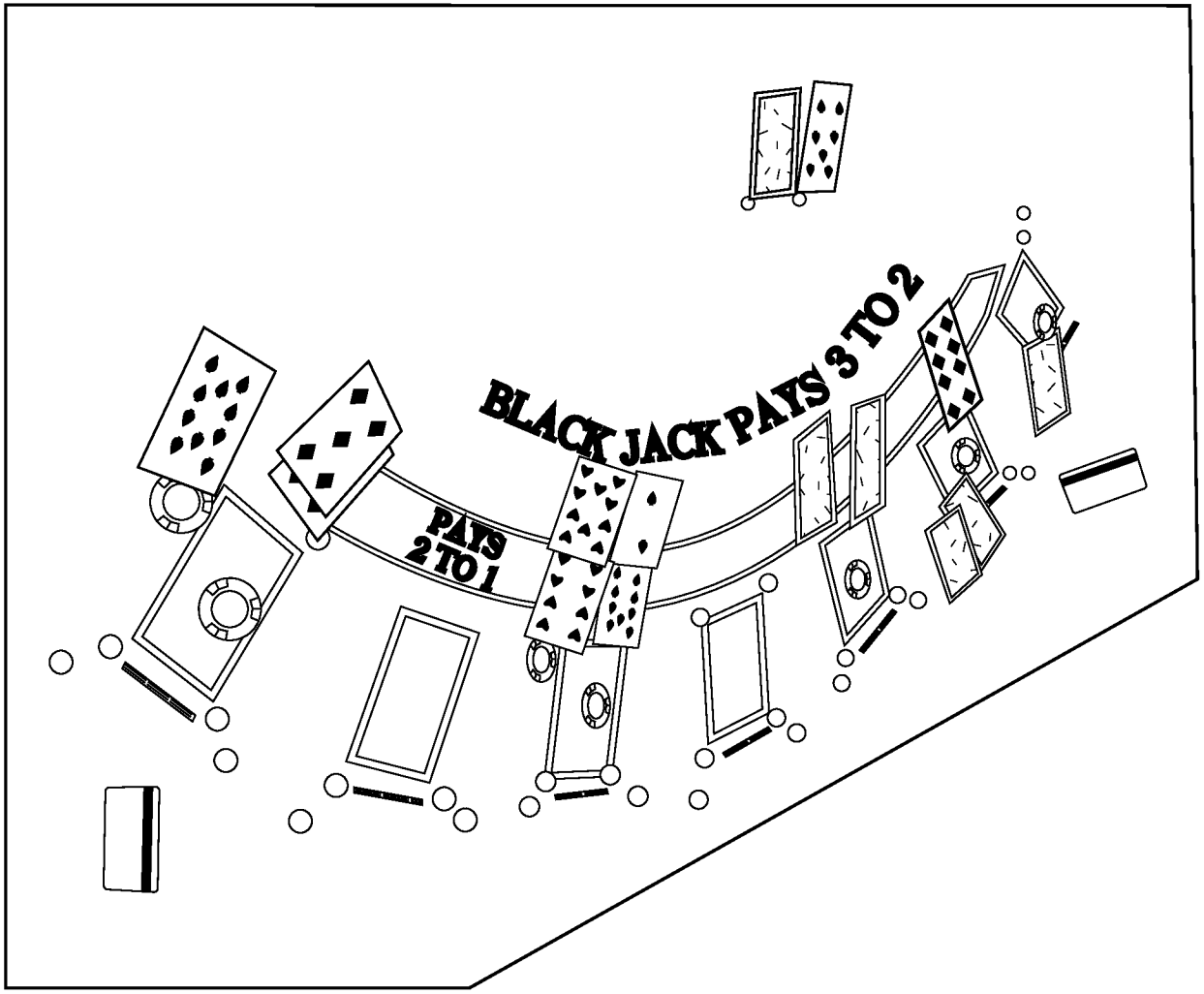
FIG. 6 shows an illustrative card table that includes a dealer area at the left and player areas.

FIG. 5 illustrates an alternative example smart card holder intended to be positioned on a table during game play according to specific embodiments. This illustrative embodiment is shown as an alternative to FIG. 1 and a number of components as shown in FIG. 5 can be understood with reference to the discussion for FIG. 1. It will be understood that not all components shown will be present in all embodiments. In this example illustration, table card holder 2 is a physical holder for playing cards with mechanical components to facilitate holding and dealing playing cards. In one example implementation, a card holder 2 has a housing as shown. A weighted card pusher 40*a* pushes the cards towards card retainer/cover 43 allowing the positioning of the playing card to be easily dispensed by a card dealer. Card cover 43 includes opening 44 from which a dealer can withdraw a card. In specific embodiments, card gate 45 is a card stop that can be activated by players' card request buttons. With these mechanical components, a single playing card can be dealt from the holder while the remaining cards stay in the holder compartment. Cards can be dealt face up or face down, though face down is the more usual configuration.

According to specific embodiments, a table holder, like an HHCH, includes one or more of several electronic components, as described below. These generally are powered by a power supply, such as 30, which may be rechargeable and/or replaceable, as is understood in the art, and optionally may be attachable to power cord 31 to receive power and/or for recharging. Logic processing electronics 32 provides the digital data processing ability to facilitate operation of the card holder. In terms of its overall electrical and central logic processing operation, card holder 2 can operate and be constructed in a similar fashion to any familiar portable or desktop electronic information processing device. Thus, a card holder can be constructed using any portable power supply (such as a battery) as used in portable computers. Recharging can be by means of switching batteries, connecting to a power cord, or other connecting means as understood for other information devices. Electronics 32 can include any logic processing devices such as generic microprocessors, customized microprocessors, RAM memory, ROM memory, interface circuits, ASICs, non-volatile memory, hard disk storage, memory card storage and/or interfacing, etc. Such components are well understood as used in portable devices such as computers, cell phones, cameras, media players, etc. Electronics 32 also generally will contain one or more network interfaces 33, such as secure Wi-Fi, Bluetooth, or wireless Ethernet, or a wired network connection that allows the holder to communicate with external data handling systems within the casino, also as will be familiar in the art.

Output 34 can include a visual display screen or lights or audio speaker as know in the portable device art for presenting information to a user. Input controls 35 can include any type of touch-sensitive buttons or screen for receiving user input.

One variation from the holder shown in FIG. 1 is the number and arrangement of some of the optical, RF, or magnetic interfaces. FIG. 5 shows optical scanner 13*a*, transponder 14*a*, and magnetic interface 15*a*. In general terms, these are designed to work in relation to a card leaving a shoe just as described above. Furthermore, this example shows two slots for player identify cards, 17*b* and 17*c*. In the option of 17*b*, one or more interfaces 13*a*, 14*a*, and/or 15*a* are used to interface with player identification cards as well as playing cards. Note that this dual use would also be possible in some embodiments of an HHCH. An alternative slot for player identification cards 17*c* is shown, with its own set of possible interfaces 13*b*, 14*b*, and/or 15*b*.

Another variation from the holder shown in FIG. 1 is that in some embodiments, there will be one additional interface, such as 14*c* to connect the antenna and transponders in table 20. In general, though the table-positioned shoe can operate in a system that performs all of the features described above, the table-positioned shoe must use external devices to scan cards once they leave the shoe or to track chips or other table activity.

Interaction with Table Optical Markings

Figure 7:
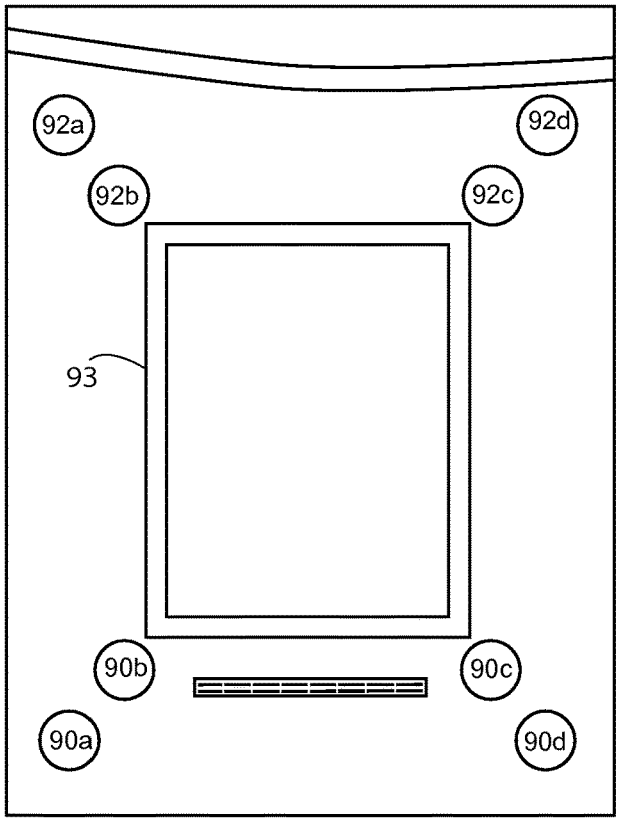
FIG. 7 shows an illustrative card table playing area for an individual player.

FIG. 7 is a representation of a card table playing area for an individual player showing sensors or indicators 90 and 92 according to specific embodiments. The figure is a line diagram of a card table playing area for an individual player, including a credit card or other player identification reader bar 91, just below a bet area indication 93, and showing eight motion indicators (or sensors) 90*a-d* and 92*a-d* according to specific embodiments described herein. These eight motion indicators and player bet area are shown in the subsequent figures without labels. Indicators may be active or passive electronic components or may be passive visible or invisible optical markings. Indicators may be on the table top, under or incorporated into a table covering (such as a felt covering), or positioned under a table. In any case, the table indicators allow an HHCH to detect motion or position of one or more playing cards during game play, as indicated further below. Indicator detection alone or a combination of indicator detection and data collected at the HHCH during card dealing, allows the described embodiment to determine or confirm game play information such as player identification, player betting area, amount bet, and type of play initiated e.g., stand, split cards, double down, etc. Each indicator 90*a-d* and 92*a-d* has its own unique position fingerprint that is detectable by the HHCH for each player position. Sensor indications 90*a-d* and 92*a-d* may be as simple as an on/off photo electric and/or proximity sensor or an optical table marking or indication. Whether sensors are electronic components or optical markings, an HHCH, according to specific embodiments, is able to uniquely identify each sensor at each player and dealer position, and as a result is able to detect aspects of card playas indicated below. The player bet area 93 is also detected by an HHCH, according to specific embodiments, as indicated by the rectangular area in the figure. An HHCH, according to specific embodiments, is able to detect the presence of chips in the bet area and adjacent to the bet area as described below. This detecting may be either optical or electronic as described herein. This detection may include also detecting the value of chips placed, either optically or electronically as described herein.

Techniques for reading various table positions from optical markings are known and described in references provided herein. Optical markings can be visible or not visible, can include optical identifications, such as barcodes, and can be associated with visible text or markings on a table indicating appropriate positions for activating various table functions.

In the examples given below, card play for the game of blackjack is determined or confirmed by an HHCH collecting data from two indicators at each of the four corners of a player bet area 93, as described below. Two indicators are shown at each corner as an example, and each corner could have one indicator or three or more indicators. Indicators may be variously arranged at a player area for different games or to conform to different styles of game play at particular areas. Indicators may have text printed near or on or over them to indicate the interpretation of each indicator by an HHCH. Typically, active or passive indicator data will be collected by an HHCH and displayed to a dealer such as on display 34 and a dealer may change or override or amend sensed activity by use of one or more dealer switches 35.

Figure 8:
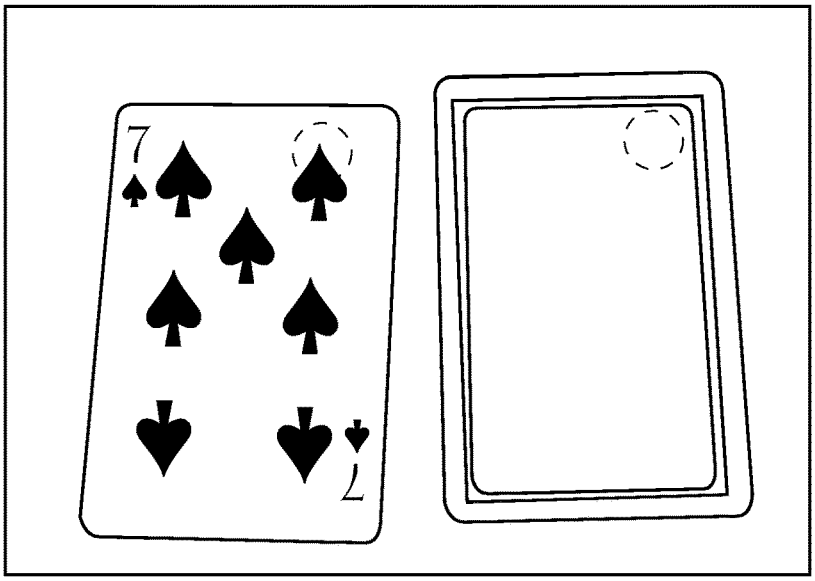
FIG. 8 shows an illustrative card table with a dealer area.

FIG. 8 is a representation of a card table showing a dealer receiving his first two cards, receipt of which is confirmed by an HHCH detecting covering of at least two different dealer area table indicators. The dealer's first dealt card is placed over the dealers first card indicator, indicating the dealer has received the first playing card, which also indicates the dealer is the last active game participant for the first card round. The next card to be dealt (second card round) to a player will indicate that said player is the first player on the dealer's left. It is known when a dealer is dealt two cards that indicate the dealer has a blackjack, as the HHCH has already scanned cards as they are dealt to all game participants. The dealer's card position indicator will be used as the end of each round of cards dealt, and establishes or helps to confirm a known order of cards dealt to all game participants.

Figure 9:
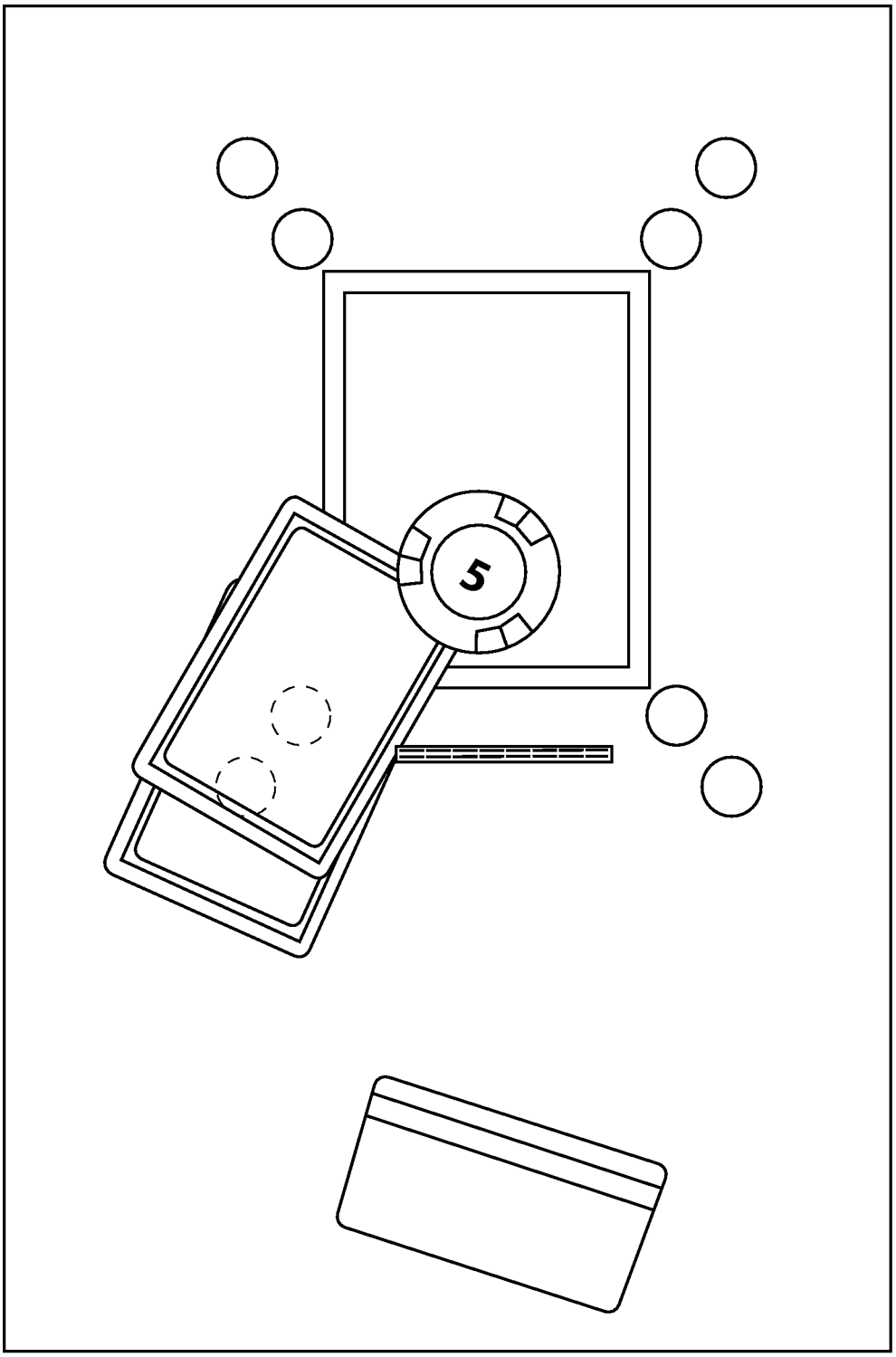
FIG. 9 shows an illustrative card table with a player indicating a stand position.

FIG. 9 is a representation of a card table showing a player indicating a stand position. A stand is generally indicated when a player places their first two cards on a specific area on the gaming table, which position has card indicators that the HHCH can used to detect the presence of playing cards. The dealer is aware that cards normally placed on that position visually indicate to the dealer that the player does not wish to receive any more playing cards. The interfacing of table card location indicators, player identification, and the known card values dealt to the player, allows the table accounting software to know all significant details regarding a specific player's activity. In this example, a stand is indicated by the player placing two cards over the two lower left indicators (90*a-b*), though other arrangements of indicators are possible. A text indication, such as "STAND" may be printed on the table or felt at the location of the two indicators.

Figure 10:
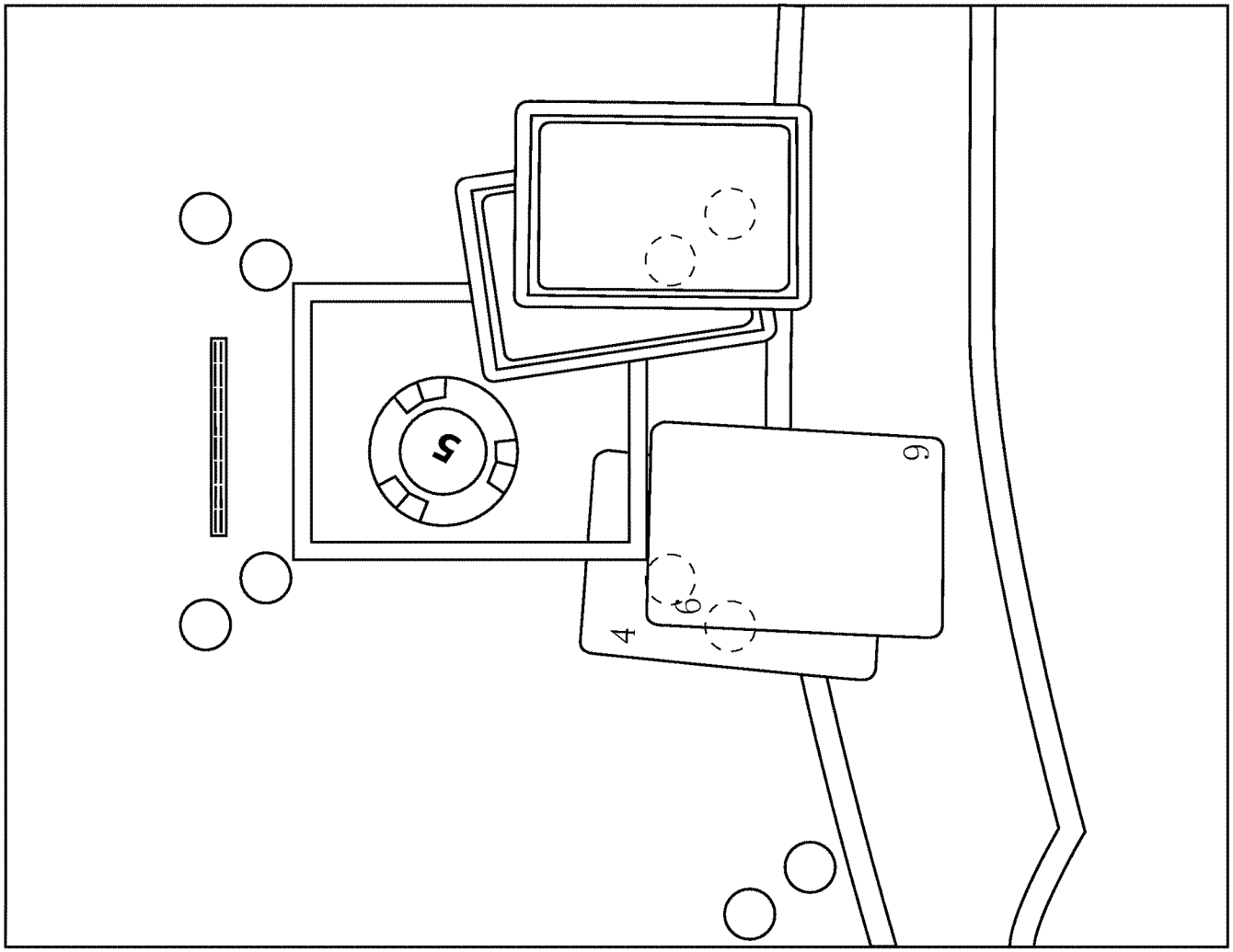
FIG. 10 shows an illustrative card table with a card table showing a player indicating a hit position according to illustrative embodiments presented herein.
Figure 11A:
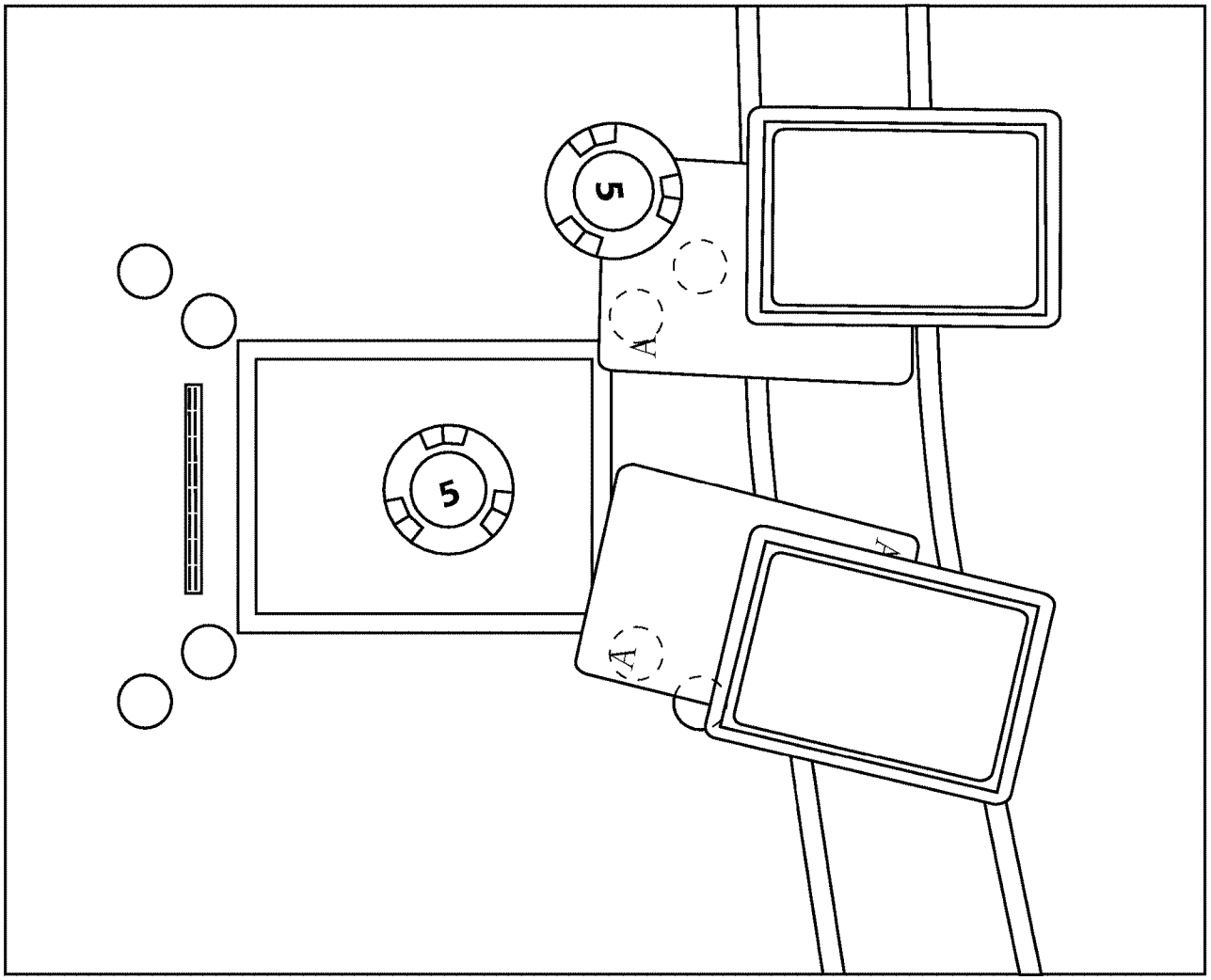
FIGS. 11A and 11B shows illustrative representations of a card table player area, in which a player has split an initial pair, such as eights (in A) or aces (in B) and the sensors or indicators (e.g., visible circles) may be used to detect positions of split cards.
Figure 11B:
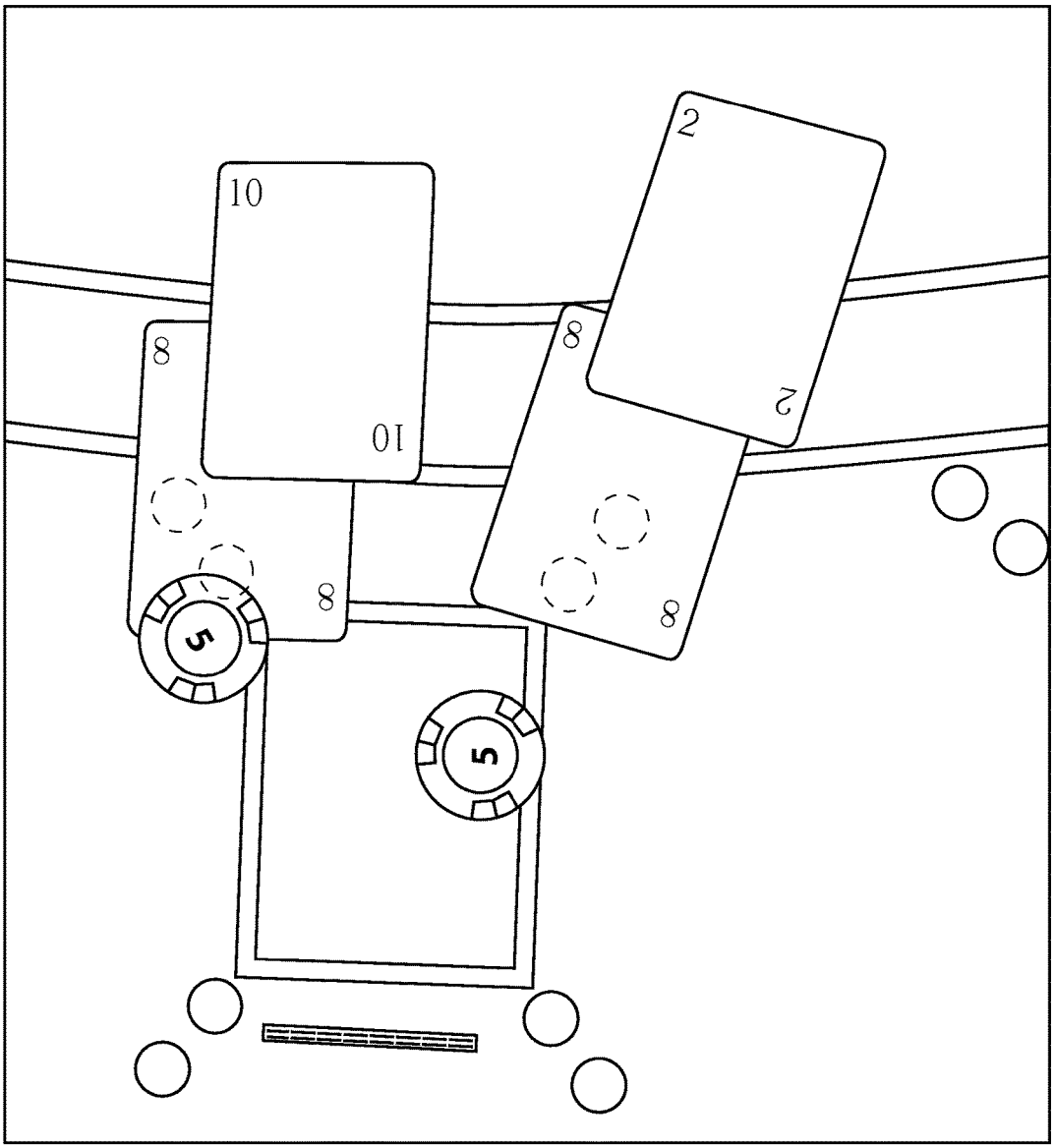

FIG. 10 is a representation of a card table showing a player indicating a hit position. A hit occurs when a player wishes to receive extra playing cards added to the first two cards received. According to specific embodiments described herein, in the game of blackjack the card shoe knows the value of the first two cards received by the player and dealer, the "hit" cards are placed according to table indicators that indicate the type of play by the player. The table electronic system can inform the player, and dealer, when no extra cards are allowed to be dealt to the player (e.g., because they are bust). In specific embodiments, a hit may be indicated by a player placing their cards over one or more upper left indicators, such as 92*a-b*. A text indication, such as "HIT" may be printed on the table or felt at the location of the two indicators. As additional cards are dealt to the hit position, they can be sensed via indicators 92*c* and 92*d* on the table by the HHCH FIGS. 11A and 11B are representations of a card table player area showing a player that has chosen to split an initial pair, such as aces (in A) or eights (in B) showing that cards covering optical indicators can detect positions of split cards. As will be understood in the art, if the player receives two cards of equal value, they have the option of "splitting" them into two separate hands. A "split" is two separate hands played separately. A player must match their original bet if they split. A player may "split" a "pair" i.e. two eights, if they get another eight they may split once more. If the split cards are aces, then aces are generally allowed to have one card each dealt to each split card. When two separate hands are initiated, the split aces, are placed over card location indicators, which indicate that the splitting of Aces is occurring. The card shoe has already scanned both cards, and knows the value of each card dealt to the two separate playing hands. Thus, when the HHCH detects that indicators in both the left and right portions (such as 92*a-b* and 92*c-d*) have been activated and that a pair has been dealt, the HHCH can determine that a player has chosen to split a pair.

Figure 12:
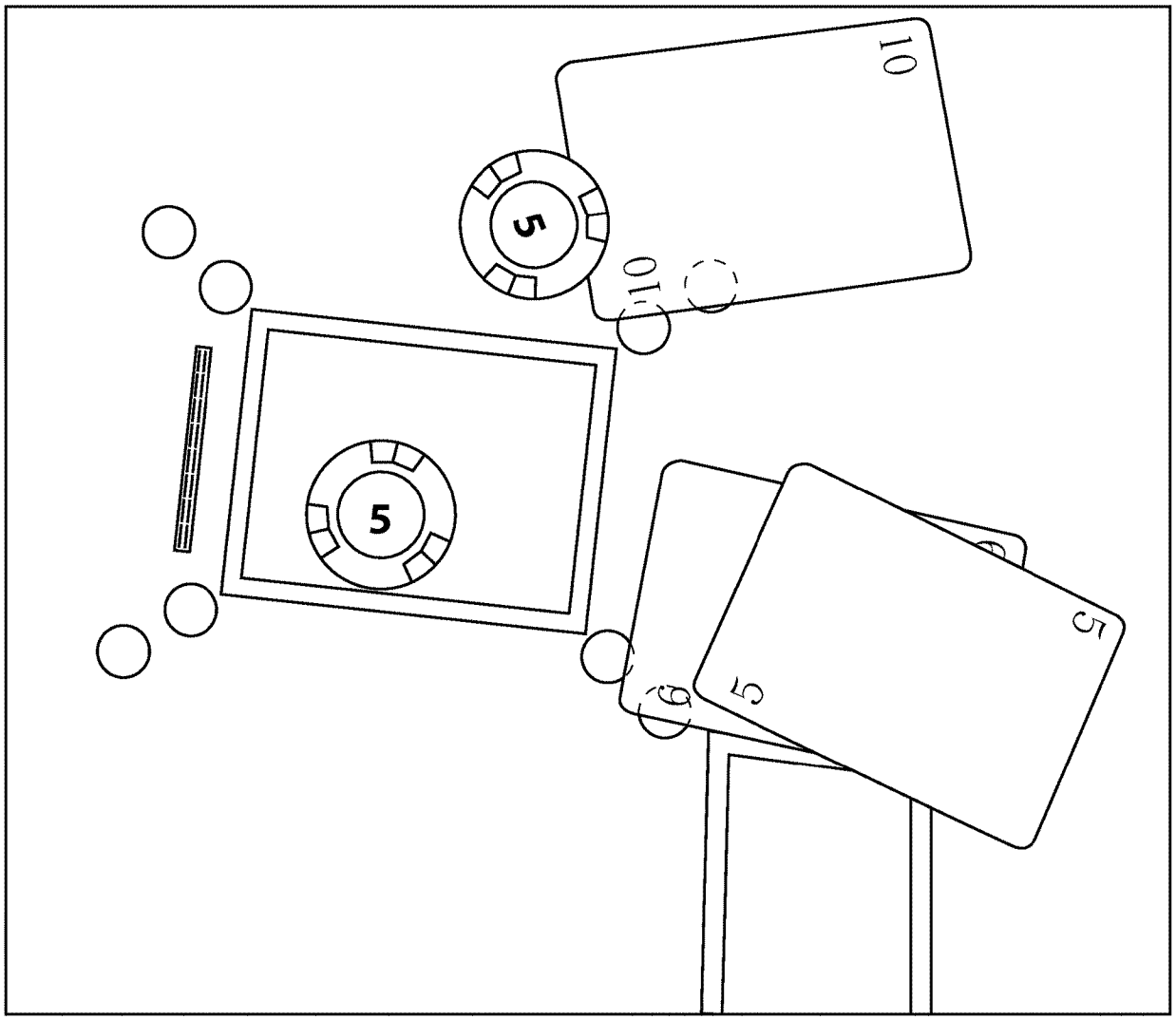
FIG. 12 shows an illustrative representation of a card table with a player indicating a double down play detected by illustrative sensors or indicators.

FIG. 12 is a representation of a card table showing a player indicating a double down play detected by indicators according to specific embodiments described herein. In this play, using a described table, a player or dealer places their first two cards in the position shown, which may have concealed infrared or other indicators in the table as discussed herein and as indicated by indicators 92*c-d*. The illustrated position of the cards, indicate the player has doubled their original bet.

Figure 13:
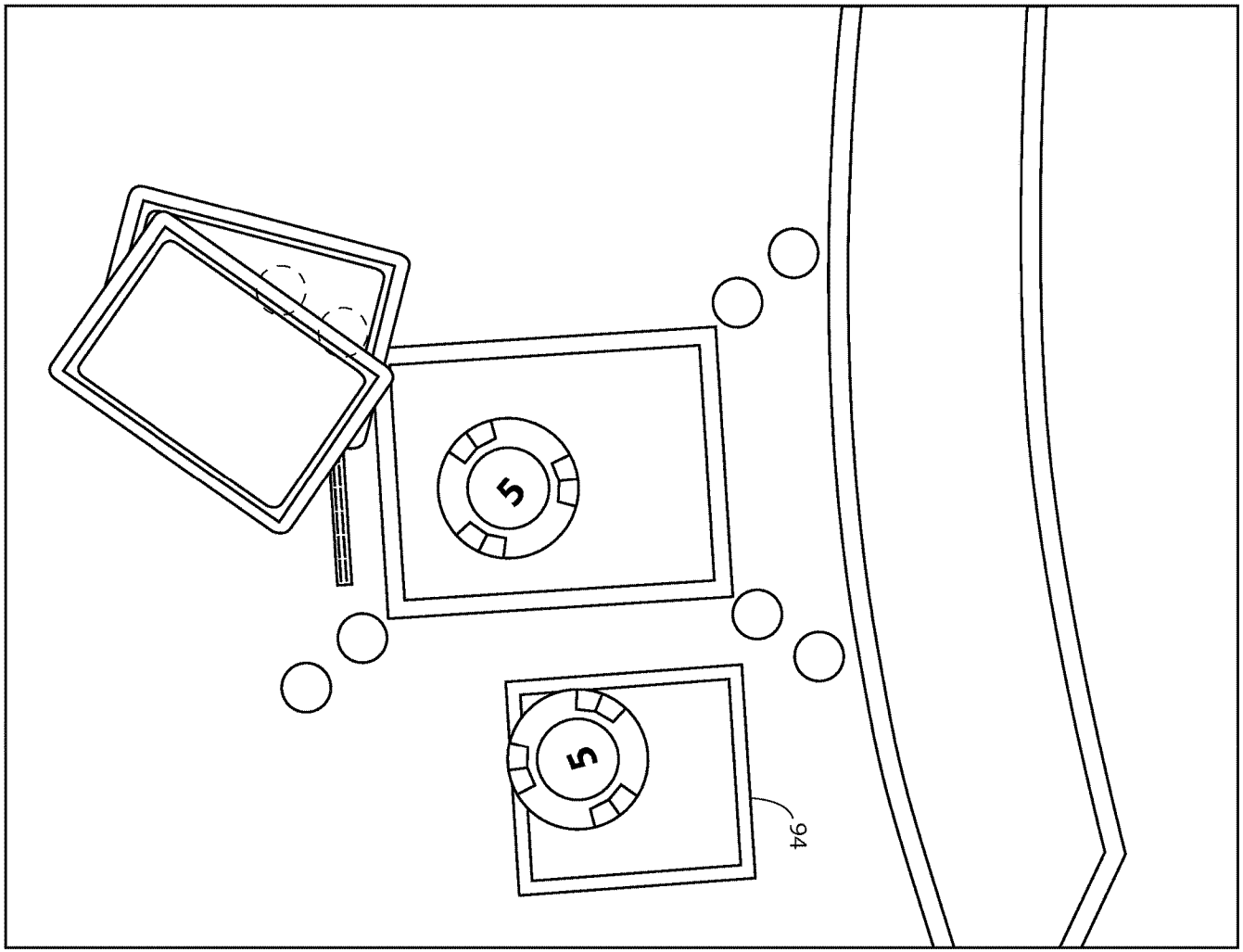
FIG. 13 shows an illustrative representation of a card table with a player indicating a side bet detected with the illustrative sensors or indicators.

FIG. 13 is a representation of a card table showing a player indicating a side bet detected by indicators according to specific embodiments. In this play, using a table described here, a player places two gaming chips. The chip in the betting area 93 is the main bet. The other gaming chip is a side bet, and is placed over the indicator for side bets. Both indicators are within a known player's betting area. In alternative embodiments, an HHCH according to specific embodiments, can optically detect the betting area and chips and can thereby detect placement of a side bet.

Figure 14:
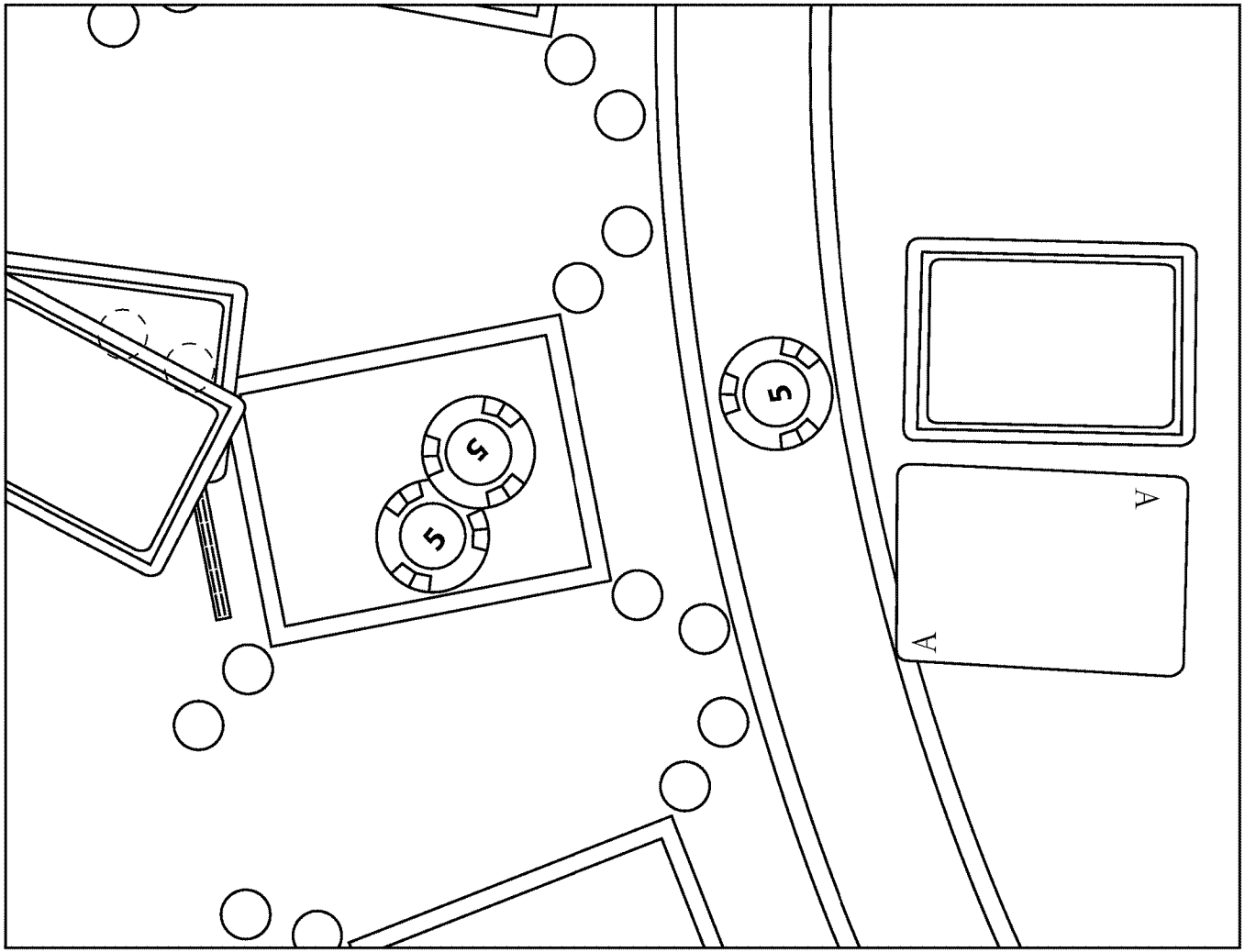
FIG. 14 shows an illustrative representation of a card table having a player indicating an optional insurance bet detected with the illustrative sensors or indicators.

FIG. 14 is a representation of a card table showing a player indicating an optional insurance bet detected by indicators according to specific embodiments. In this play, using a table described herein, if the dealer shows a face up card that is an ace, players can place a bet for 50% of their main bet in a location dedicated to such bets. The insurance area where a player will place his bet has an indicator that activates signals that identify the player and his play position at the table. As the main bet is known it is not necessary to scan insurance bets. If the dealer has a blackjack then the player wins 2 times their insurance bet, if the dealer does not have a blackjack then the player loses his insurance bet. According to specific illustrative embodiments, the motion indicators embedded in the table detect the play of an insurance bet and the information about game play can let players and/or dealers know if an insurance bet is allowable.

Figure 15:
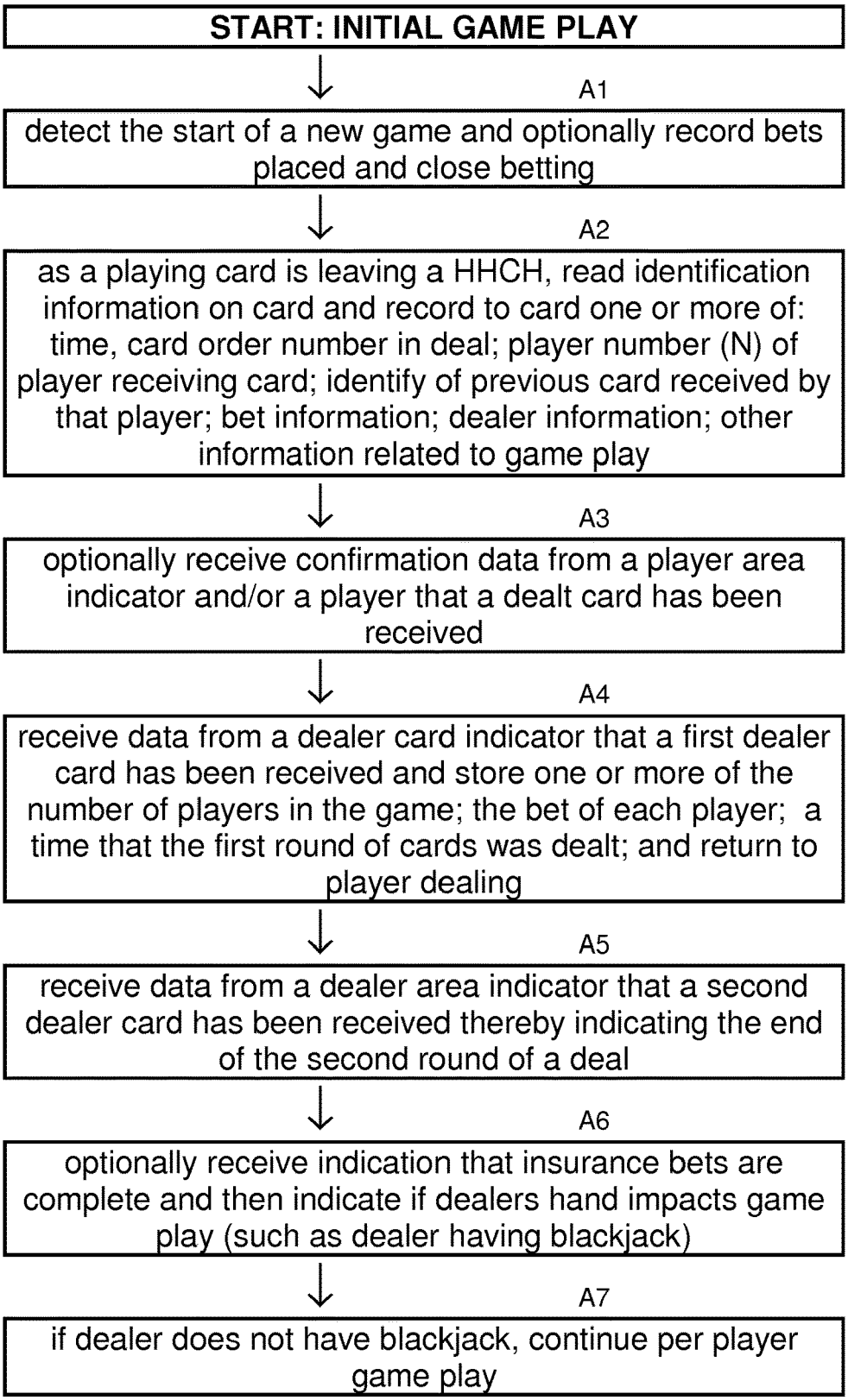
FIG. 15 shows an illustrative flowchart representation of a dealer receiving his first two cards.
Figure 16:
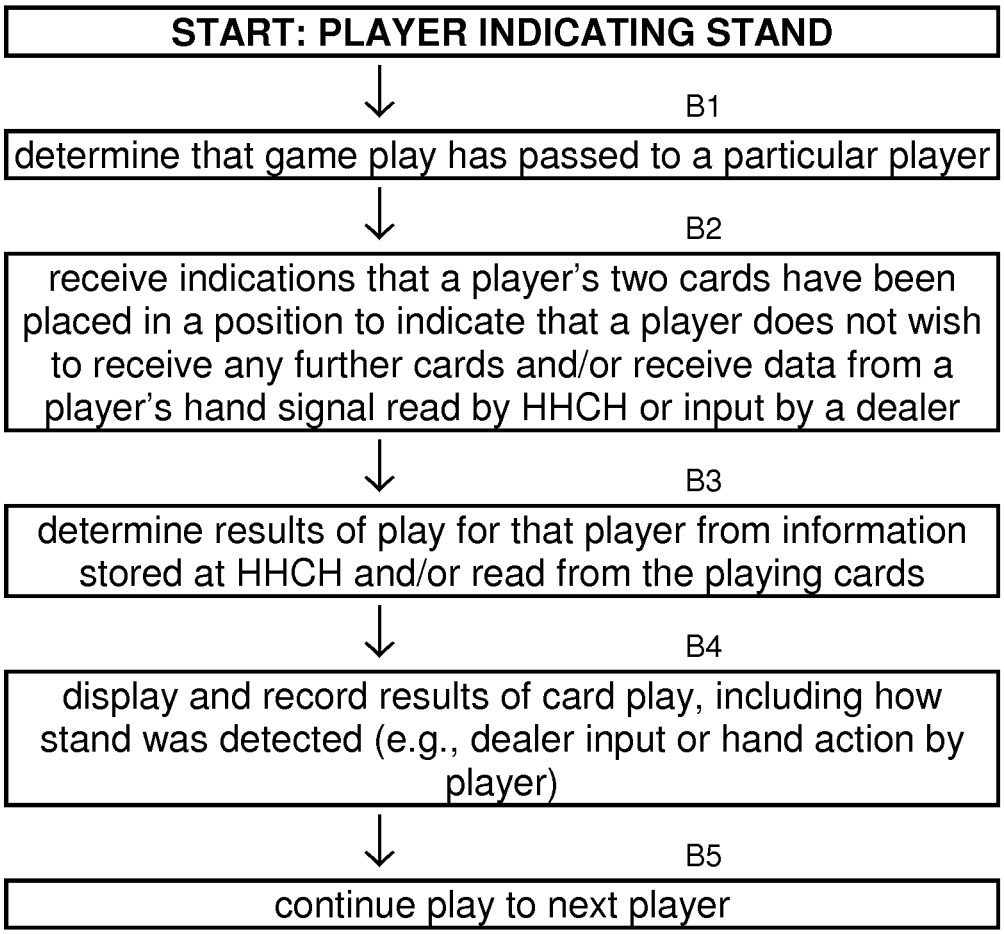
FIG. 16 shows an illustrative flowchart representation of a player indicating a stand position.
Figure 17:
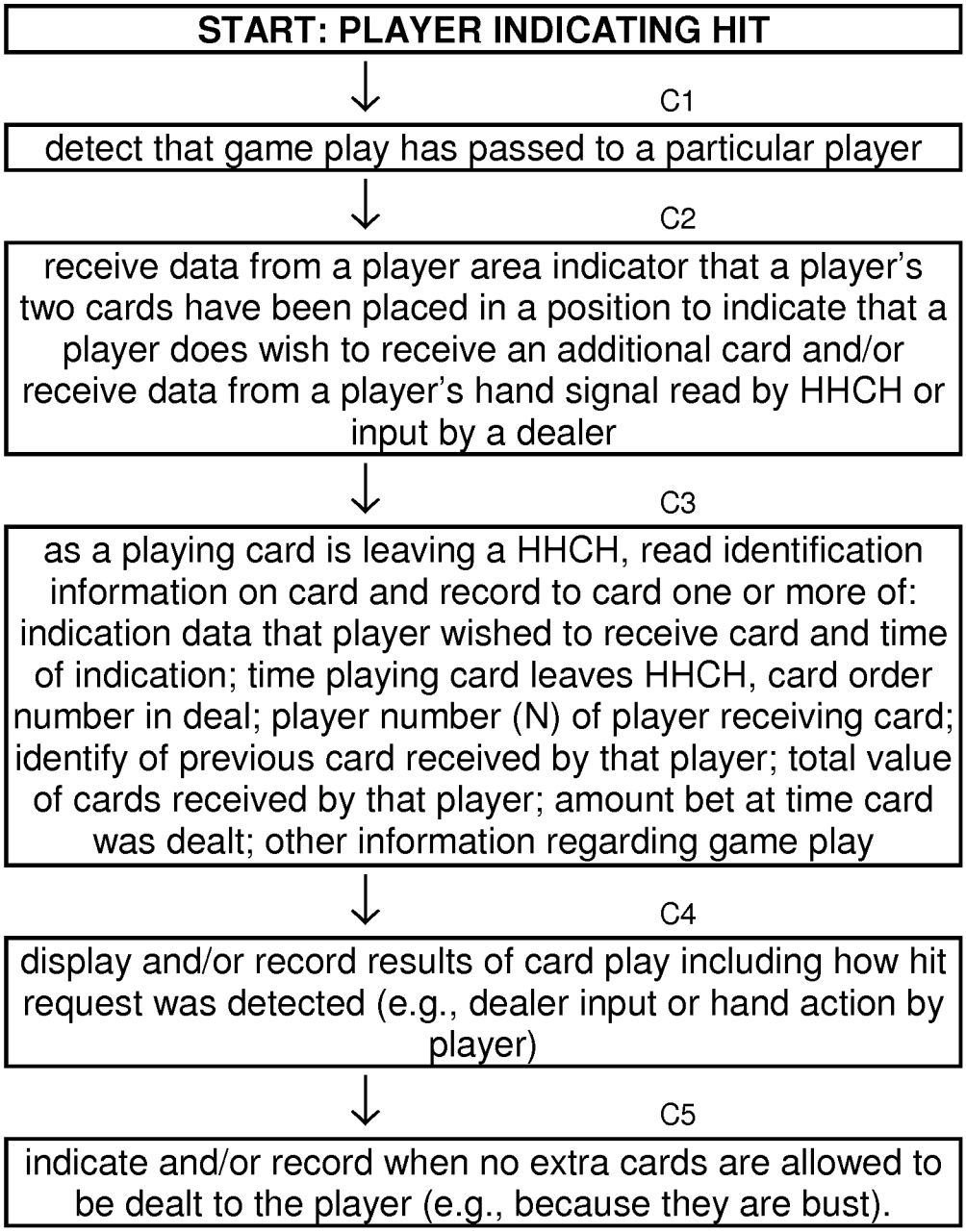
FIG. 17 shows an illustrative flowchart representation of a player indicating a hit position.
Figure 18:
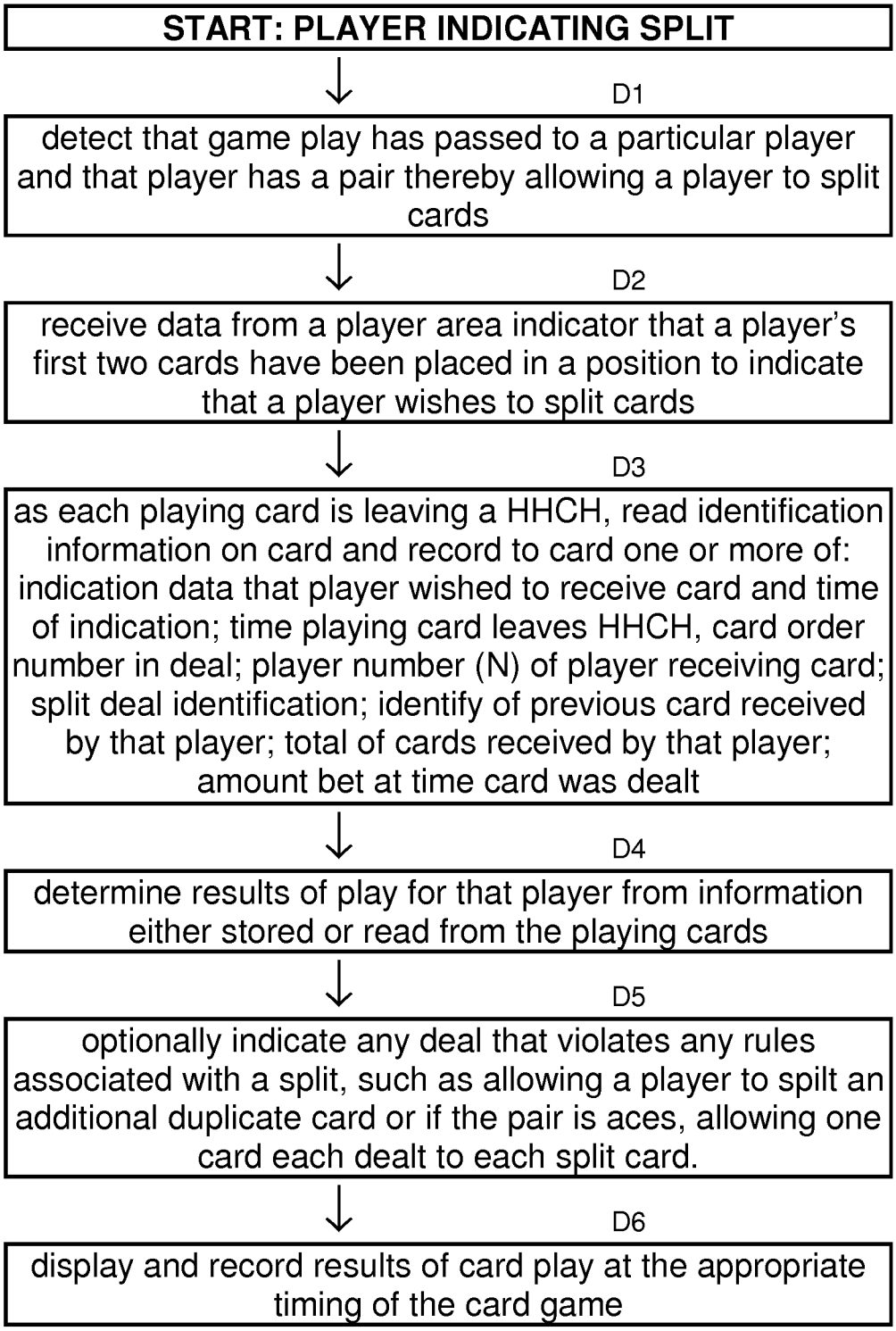
FIG. 18 shows an illustrative flowchart representation of a player indicating splitting a pair.
Figure 19:
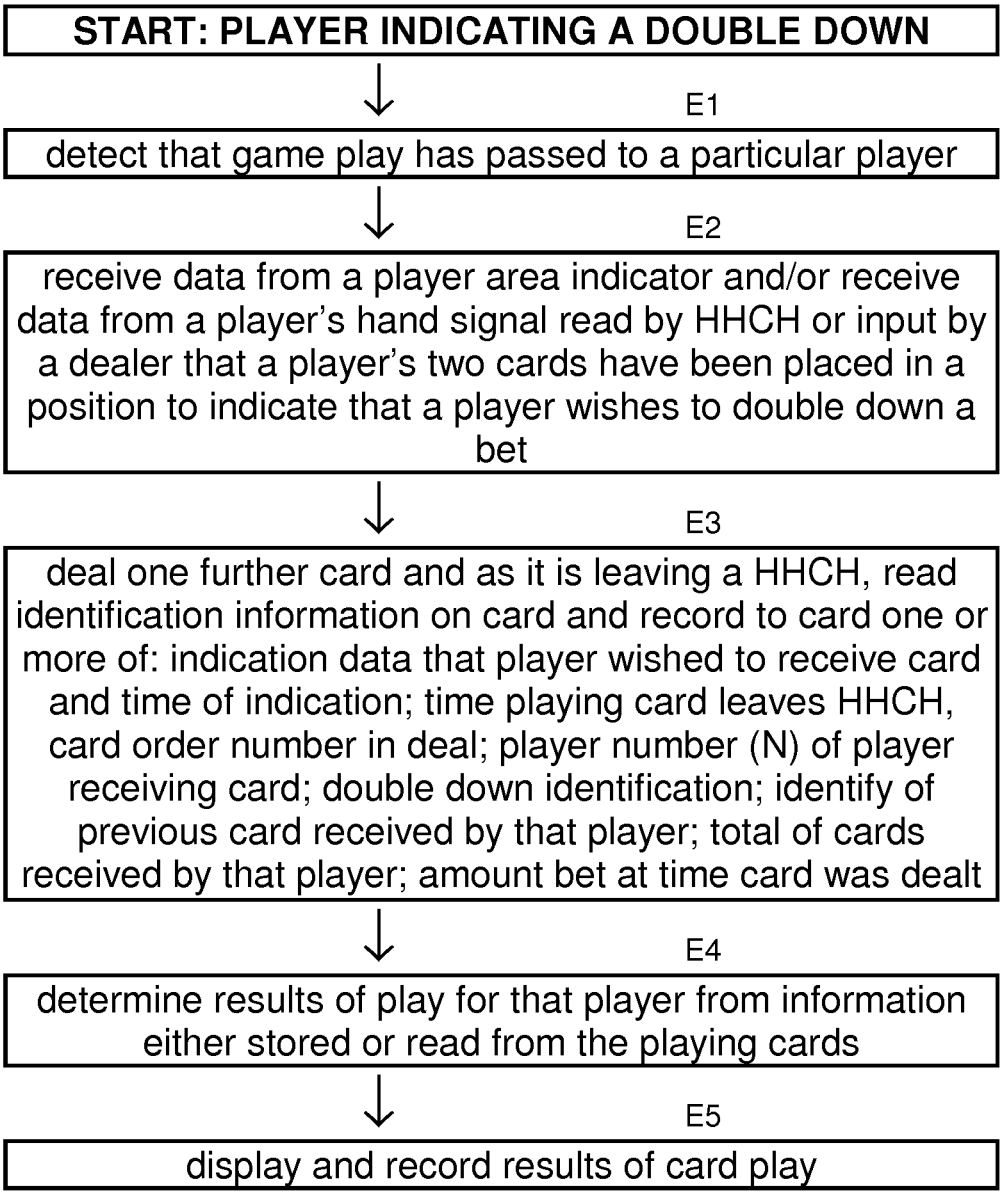
FIG. 19 shows an illustrative flowchart representation of a player indicating a double down.
Figure 20:
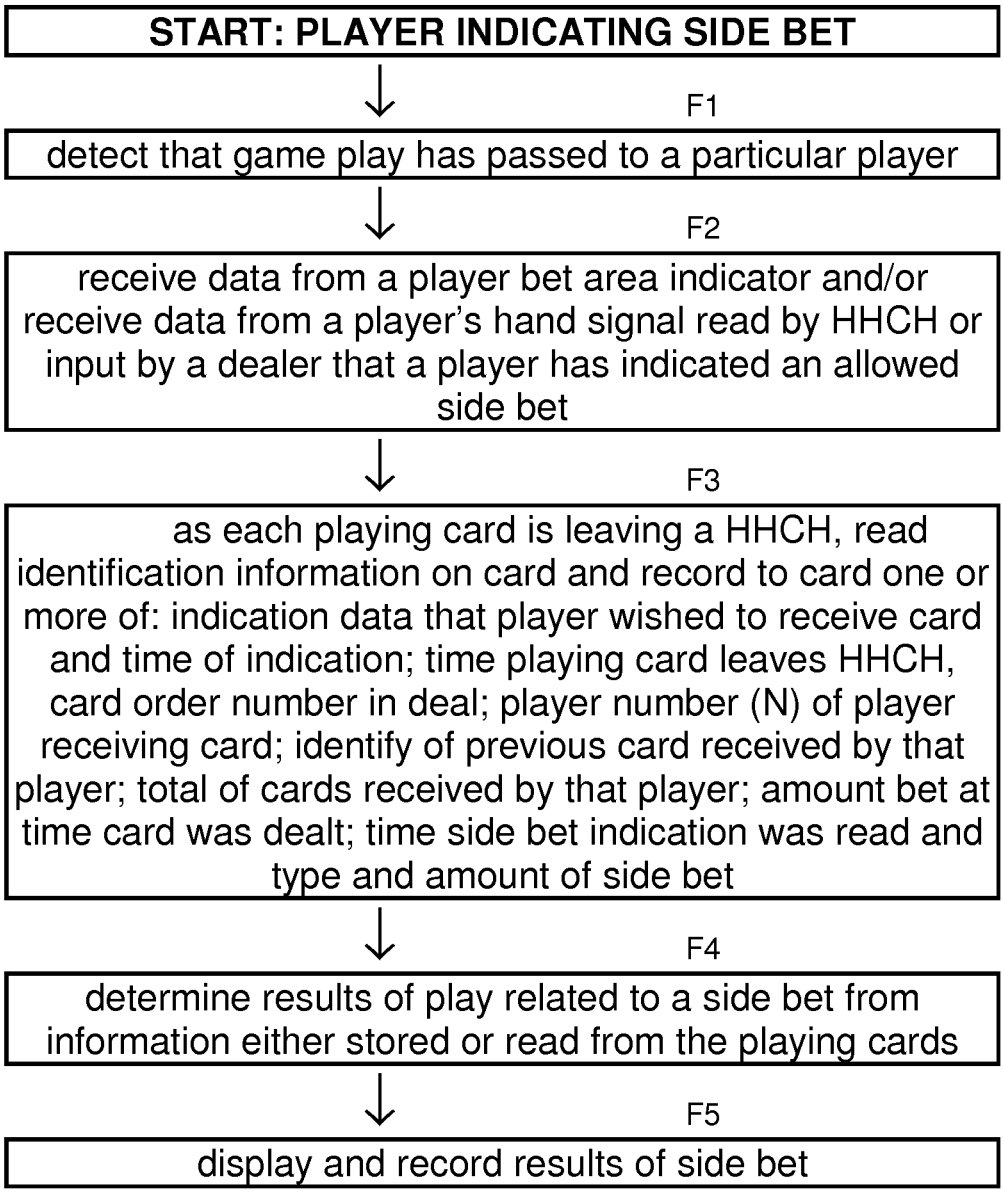
FIG. 20 shows an illustrative flowchart representation of a player indicating a side bet detected by the illustrative sensors or indicators.
Figure 21:
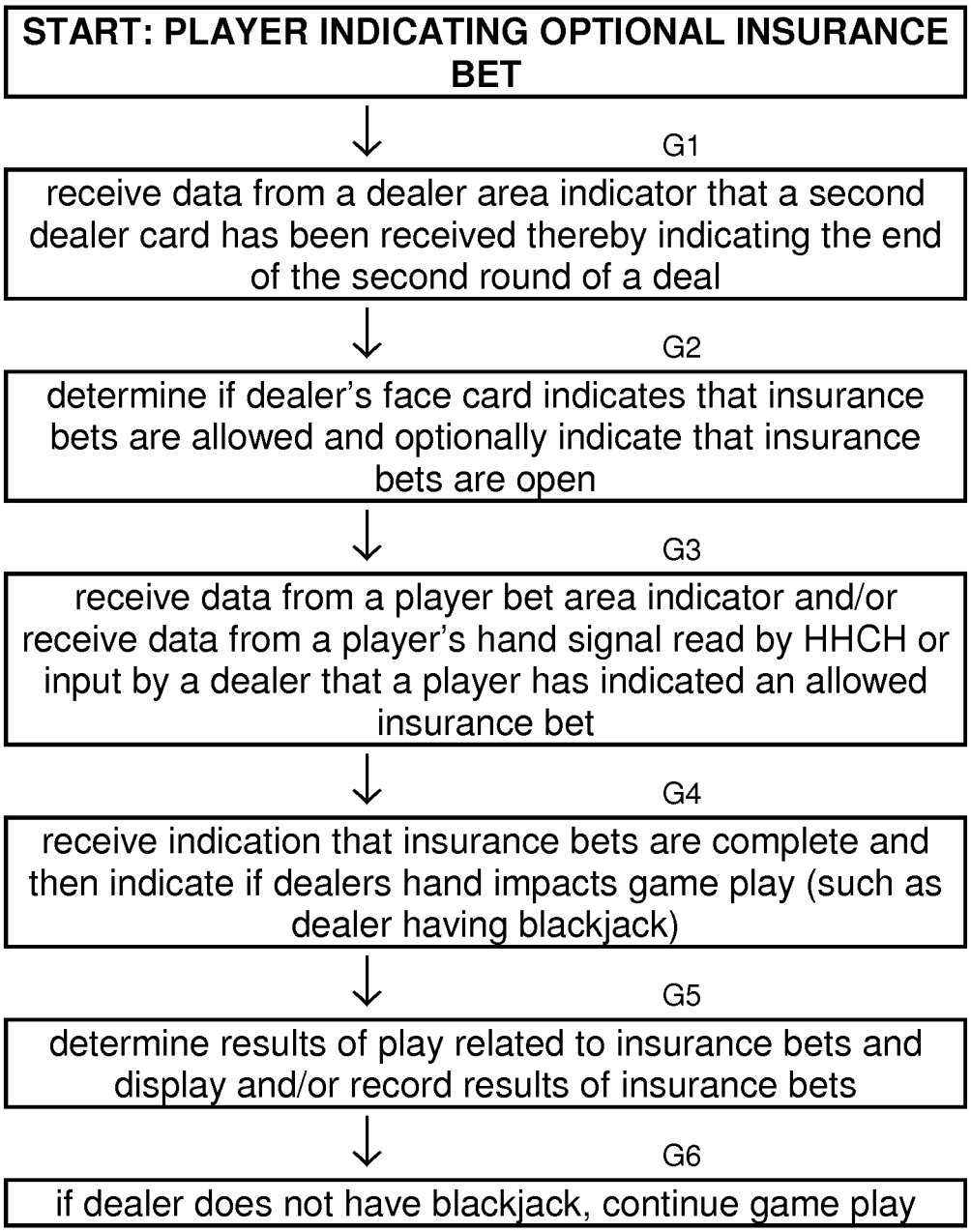
FIG. 21 shows an illustrative flowchart representation of a player indicating an insurance bet detected by the illustrative sensors or indicators.

FIGS. 15-21 are flowchart representations showing operation of a system during game play according to specific embodiments. These flowcharts are provided as examples only and are not limiting in the various operations of the illustrative embodiments. FIG. 15 is a flowchart representation of a dealer receiving his first two cards according to specific embodiments described herein. FIG. 16 is a flowchart representation of a player indicating a stand position according to specific embodiments described herein. FIG. 17 is a flowchart representation of a player indicating a hit position according to specific embodiments described herein. FIG. 18 is a flowchart representation of a player indicating splitting a pair according to specific embodiments described herein. FIG. 19 is a flowchart representation of a player indicating a double down according to specific embodiments described herein. FIG. 20 is a flowchart representation of a player indicating a side bet detected by sensors or indicators according to specific embodiments described herein. FIG. 21 is a flowchart representation of a player indicating an insurance bet detected by sensors or indicators according to specific embodiments described herein.

Embodiment in a Programmed Information Appliance

Figure 22:
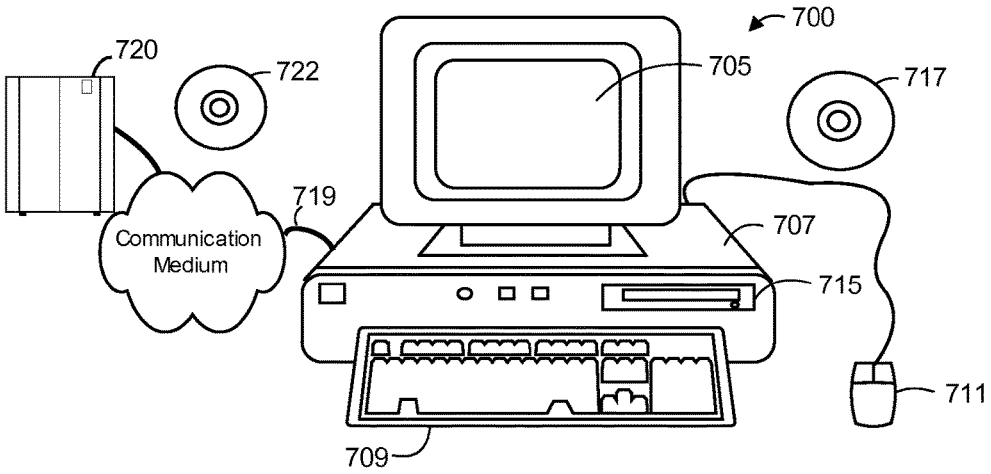
FIG. 22 shows an illustrative block diagram showing a representative example logic device which may be present in illustrative embodiments described herein.

FIG. 22 is a block diagram showing a representative example logic device in which various aspects of the illustrative embodiments may be embodied. As will be understood to practitioners in the art from the teachings provided herein, the illustrative embodiments can be implemented in hardware and/or software. In some embodiments, different aspects of the illustrative embodiments can be implemented in either client-side logic or server-side logic. As will be understood in the art, the illustrative embodiments or components thereof may be embodied in a fixed media program component containing logic instructions and/or data that when loaded into an appropriately configured computing device cause that device to perform according to the illustrative embodiments. As will be understood in the art, a fixed media containing logic instructions may be delivered to a user on a fixed media for physically loading into a user's computer, or a fixed media containing logic instructions may reside on a remote server that a user accesses through a communication medium in order to download a program component.

FIG. 22 shows an information appliance (or digital device) 700 that may be understood as a logical apparatus that can read instructions from media 717 and/or network port 719, which can optionally be connected to server 720 having fixed media 722. Apparatus 700 can thereafter use those instructions to direct server or client logic, as understood in the art, to embody aspects of the illustrative embodiments. One type of logical apparatus that may represent the illustrative embodiments is a computer system as illustrated in 700, containing CPU 707, optional input devices 709 and 711, disk drives 715 and optional monitor 705. Fixed media 717, or fixed media 722 over port 719, may be used to program such a system and may represent a disk-type optical or magnetic media, magnetic tape, solid state dynamic or static memory, etc. Specific embodiments may be embodied in whole or in part as software recorded on this fixed media. Communication port 719 may also be used to initially receive instructions that are used to program such a system and may represent any type of communication connection.

The illustrative embodiments also may be embodied in whole or in part within the circuitry of an application specific integrated circuit (ASIC) or a programmable logic device (PLD). In such a case, the illustrative embodiments may be embodied in a computer understandable descriptor language, which may be used to create an ASIC, or PLD that operates as herein described.

OTHER EMBODIMENTS

Though specific illustrative embodiments have been described here, other embodiments will be apparent to those of skill in the art. In particular, a user digital information appliance has generally been illustrated as a personal computer. However, the digital computing device is meant to be any information appliance for interacting with a remote data application, and could include such devices as a digitally enabled television, cell phone, personal digital assistant, laboratory or manufacturing equipment, etc. It is understood that the examples and embodiments described herein are for illustrative purposes and that various modifications or changes in light thereof will be suggested by the teachings herein to persons skilled in the art and are to be included within the spirit and purview of this application and scope of the claims.

Furthermore, various different actions can be used to effect a gaming transaction. For example, a voice command may be spoken by the purchaser, a key may be depressed by the purchaser, a button on a client-side scientific device may be depressed by the user, or selection using any pointing device may be affected by the user.

All publications, patents, and patent applications cited herein or filed with this application, including any references filed as part of an Information Disclosure Statement, are incorporated by reference in their entirety.

It is to be understood that the detailed description of illustrative embodiments are provided for illustrative purposes. The scope of the claims is not limited to these specific embodiments or examples. Therefore, various elements, details, execution of any methods, and uses can differ from those just described, or be expanded on or implemented using technologies not yet commercially viable, and yet still be within the inventive concepts of the present disclosure. The scope of the invention is determined by the following claims and their legal equivalents.

What is claimed:

1. A card holder comprising:

a holding compartment that receives a plurality of read and write playing cards;

a read electronic component for reading a gaming chip and at least one of the read and write playing cards;

a write electronic component for writing to the gaming chip and at least one of the read and write playing cards, wherein the write electronic component writes data to each read and write playing cards indicating at least one of a time dealt, a player identity, a dealer identity, and an active bet at the time dealt;

a memory communicatively coupled to the read electronic component and the write electronic component that stores a unique identity for each read and write playing card; and a control system that is communicatively coupled to the read electronic component, the write electronic component and the memory.

2. The card holder of claim 1 wherein the write electronic component writes to each read and write playing card during game play.

3. The card holder of claim 1 further comprising a dispensing opening for distributing the read and write playing cards.

4. The card holder of claim 1 further comprising, a second read electronic component for reading a gaming chip; and a second write electronic component for writing to the gaming chip.

5. A card holder comprising:

a holding compartment that receives a plurality of read and write playing cards;

a read electronic component for reading at least one of the read and write playing cards;

a write electronic component for writing to at least one of the read and write playing cards, wherein the electronic writes to each read and write playing card during game play, wherein the write electronic component writes data to each read and write playing cards indicating at least one of a time dealt, a player identity, a dealer identity, and an active bet at the time dealt;

a memory communicatively coupled to the read electronic component and the write electronic component that stores a unique identity for each read and write playing card; and a control system that is communicatively coupled to the read electronic component, the write electronic component and the memory.

6. The card holder of claim 5 further comprising a dispensing opening for distributing the read and write playing cards.

7. The card holder of claim 5 further comprising, a second read electronic component for reading a gaming chip; and a second write electronic component for writing to the gaming chip.

8. The card holder of claim 5 wherein the read electronic component reads a gaming chip, and wherein the write electronic component writes to the gaming chip.

9. A method for operation of a card holder, the method comprising:

receiving a plurality of read and write playing cards in a holding compartment;

reading a gaming chip and at least one of the read and write playing cards with a read electronic component;

writing to the gaming chip and at least one of the read and write playing cards with a write electronic component, wherein the write electronic component writes data to each read and write playing cards indicating at least one of a time dealt, a player identity, a dealer identity and an active bet at the time dealt;

storing, by a memory communicatively coupled to the read electronic component and the write electronic component, a unique identity for each read and write playing card in a memory; and communicatively coupling the read electronic component, the write electronic component and the memory to a control system.

10. The method of claim 9 wherein the write electronic component writes to each read and write playing card during game play.

11. The method of claim 9 further comprising distributing the read and write playing cards with a dispensing opening.

12. The method of claim 9 further comprising, reading a gaming chip with a second read electronic component; and writing to the gaming chip with a second write electronic component.

* * * * *